US011179948B2

(12) United States Patent
Hammura et al.

(10) Patent No.: US 11,179,948 B2
(45) Date of Patent: Nov. 23, 2021

(54) LIQUID EJECTING HEAD AND LIQUID EJECTING APPARATUS

(71) Applicant: CANON KABUSHIKI KAISHA, Tokyo (JP)

(72) Inventors: Akiko Hammura, Tokyo (JP); Yoshiyuki Nakagawa, Kawasaki (JP); Yasuhiko Osaki, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/776,154

(22) Filed: Jan. 29, 2020

(65) Prior Publication Data

US 2020/0254758 A1 Aug. 13, 2020

(30) Foreign Application Priority Data

Feb. 8, 2019 (JP) ..... JP2019-021660

(51) Int. Cl.
*B41J 2/18* (2006.01)
*B41J 2/155* (2006.01)

(52) U.S. Cl.
CPC ..... *B41J 2/18* (2013.01); *B41J 2/155* (2013.01); *B41J 2202/12* (2013.01)

(58) Field of Classification Search
CPC ..... B41J 2202/12
See application file for complete search history.

(56) References Cited

U.S. PATENT DOCUMENTS 9,931,845 B2 4/2018 Moriya et al.
10,040,290 B2 8/2018 Okushima et al.
10,179,453 B2 1/2019 Okushima et al.
10,391,767 B2 8/2019 Osaki et al.
10,538,087 B2 1/2020 Nakagawa et al.
2016/0059551 A1 3/2016 Miyazaki et al.
2016/0288499 A1* 10/2016 Sugahara ..... B41J 2/17509
2017/0197407 A1* 7/2017 Karita ..... B41J 2/18
2017/0197416 A1* 7/2017 Moriya ..... B41J 2/18
2017/0197420 A1* 7/2017 Okushima ..... B41J 2/14145
2017/0197422 A1* 7/2017 Moriguchi ..... B41J 2/18
2017/0197439 A1* 7/2017 Okushima ..... B41J 2/1645
2019/0001671 A1 1/2019 Yamada et al.
2019/0001692 A1 1/2019 Yamazaki et al.
2019/0009535 A1* 1/2019 Osaki ..... B41J 2/14032
2019/0009554 A1 1/2019 Nakagawa

FOREIGN PATENT DOCUMENTS

JP 2017-124619 A 7/2017

* cited by examiner

*Primary Examiner* — Shelby L Fidler
(74) *Attorney, Agent, or Firm* — Venable LLP

(57) ABSTRACT

A liquid ejecting head includes, on an element substrate, an ejection orifice line formed of a plurality of ejection orifices, a plurality of pressure chambers that communicates with the ejection orifices, respectively, a first flow passage and a second flow passage that extend along the ejection orifice line and communicate with the plurality of pressure chambers, respectively, and a plurality of first openings that communicates with the first flow passage and a plurality of second openings that communicates with the second flow passage. The number of the first openings and the number of the second openings are equal to each other and even numbers. Out of the plurality of first openings and the plurality of second openings, openings positioned at both ends in an ejection orifice line direction are either the first openings or the second openings.

10 Claims, 17 Drawing Sheets

FIG. 10A
FIG. 10B
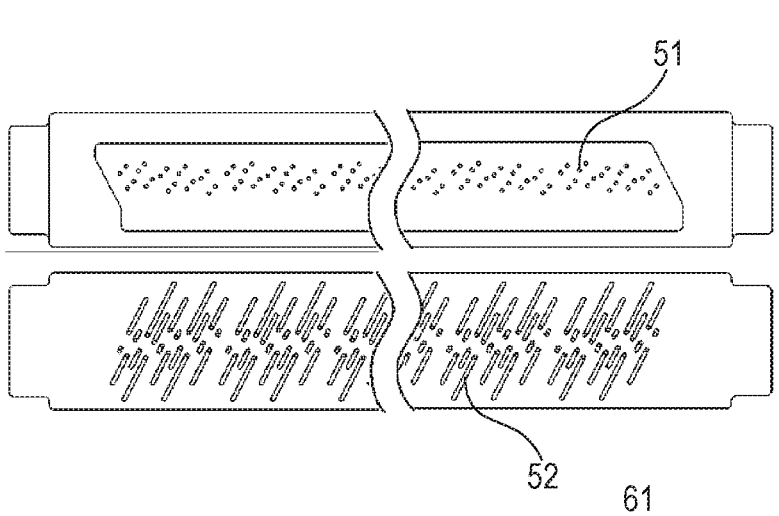
FIG. 10C
FIG. 10D
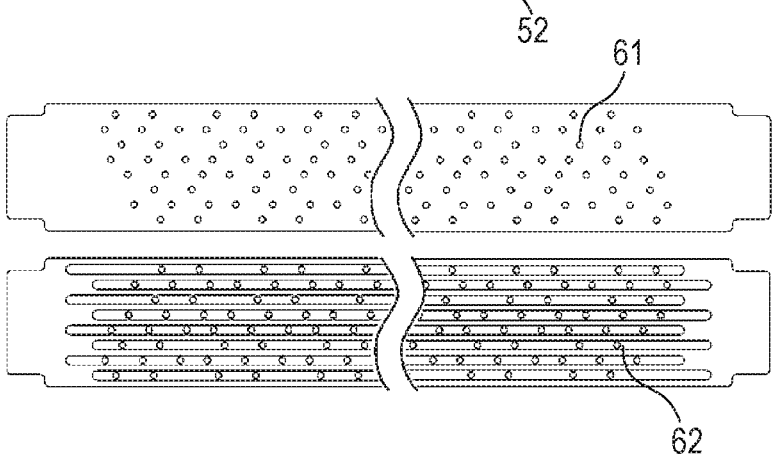
FIG. 10E
FIG. 10F
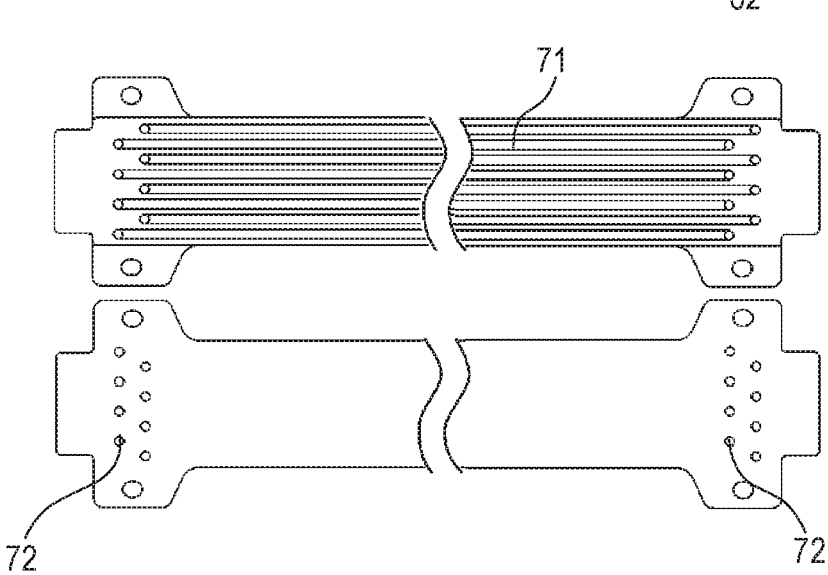

LIQUID EJECTING HEAD AND LIQUID EJECTING APPARATUS

BACKGROUND OF THE INVENTION

Field of the Invention

The present invention relates to a liquid ejecting head and a liquid ejecting apparatus.

Description of the Related Art

In a liquid ejecting head that ejects a liquid, as a volatilization component in the liquid evaporates from an ejection orifice, the liquid in the vicinity of the ejection orifice is concentrated and the viscosity of the liquid increases in some cases. Due to such a thickening phenomenon, ejection speeds of liquid droplets change, and there is a possibility that landing accuracy aggravates. In particular, in a case where a suspension time until the next liquid droplets are ejected is long after ejecting liquid droplets or in a case where there are many solid components in the liquid, an increase in the viscosity of the liquid is remarkable. An ejection failure occurs in some cases due to flow resistance of the concentrated liquid, and thus an image is not formed well.

As one countermeasure to such a liquid thickening phenomenon, a method of flowing out a thickened liquid, without letting the liquid stay in a pressure chamber where the ejection orifice is disposed, by forcibly flowing the liquid in the pressure chamber is known. However, there is a possibility that problems such as variations in the flow rate of the liquid flowing in the pressure chamber and temperature distribution in an element substrate occur. A configuration where a plurality of any one or both of an opening and a communication orifice that supply a liquid to a supply flow passage which communicates with a pressure chamber and an opening and a communication orifice that collect the liquid from a collecting flow passage which communicates with the pressure chamber is provided is disclosed in Japanese Patent Application Laid-Open No. 2017-124619. Accordingly, variations in the flow rate of the liquid flowing in the pressure chamber and temperature distribution in the element substrate are suppressed.

SUMMARY OF THE INVENTION

According to an aspect of the present invention, there is provided a liquid ejecting head including, on an element substrate, an ejection orifice line formed of a plurality of ejection orifices that ejects a liquid, a plurality of pressure chambers that communicates with the plurality of ejection orifices, respectively, a first flow passage and a second flow passage that extend along the ejection orifice line and communicate with the plurality of pressure chambers respectively, and a plurality of first openings that communicates with the first flow passage and a plurality of second openings that communicates with the second flow passage. The number of the first openings and the number of the second openings are equal to each other and even numbers. Out of the plurality of first openings and the plurality of second openings, openings positioned at both ends in an ejection orifice line direction are either the first openings or the second openings.

Further features of the present invention will become apparent from the following description of exemplary embodiments with reference to the attached drawings.

BRIEF DESCRIPTION OF THE DRAWINGS

FIGS. 10A, 10B, 10C, 10D, 10E and 10F are a plan view and a rear view of each flow passage member of the liquid ejecting head illustrated in FIGS. 8A to 9.

DESCRIPTION OF THE EMBODIMENTS

Figure 1A:
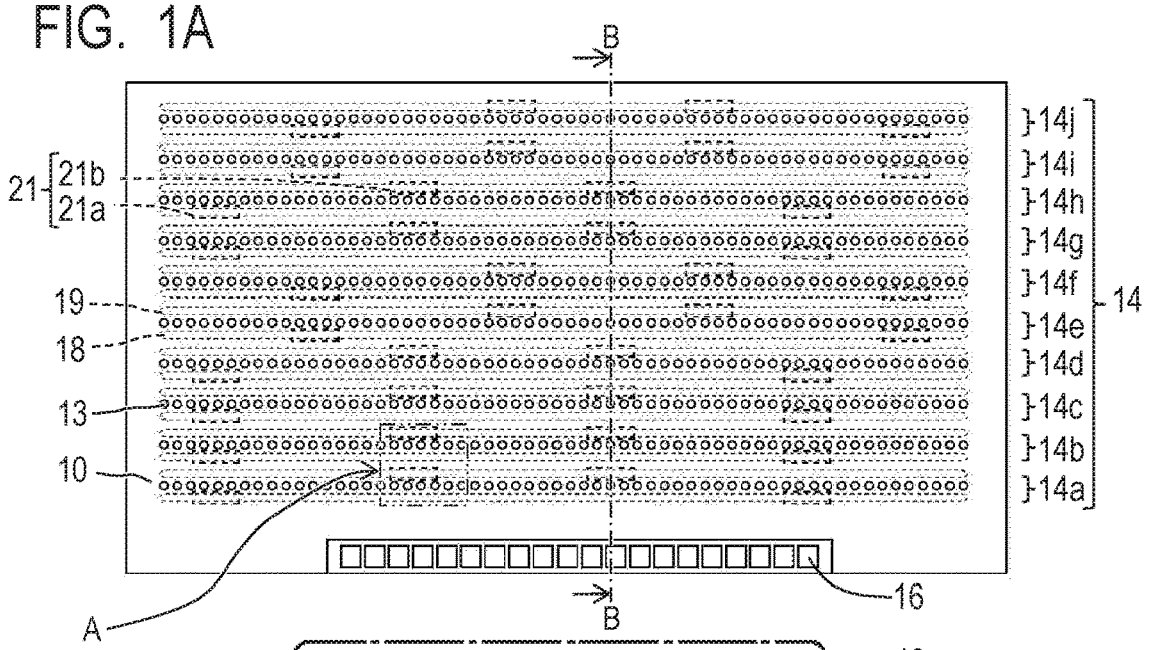
FIGS. 1A, 1B and 1C are a plan view, an enlarged view and a sectional perspective view of an element substrate of a liquid ejecting head according to the present invention.

When a plurality of openings that communicates with a supply flow passage and a plurality of openings that communicates with a collecting flow passage are provided, each interval between the openings is short. As a result, a bonding area between the openings adjacent to each other is small in a bonded surface between a plate-like member where the openings are formed and other members (for example, a supporting member), and thus there is possibility that firm adhesion is difficult. In this case, securing a bonding area necessary for maintaining stable bonding of a flow passage member between the openings by decreasing the number of the openings is considered. In a case where three communication orifices that communicate with the supply flow passage are provided and two communication orifices that communicate with the collecting flow passage are provided, the strength of bonding is insufficient as the bonding area is excessively small. In this case, by decreasing the number of the openings and providing, for example, two openings that communicate with the supply flow passage and two openings that communicate with the collecting flow passage, the strength of bonding is able to be improved. In a case where different types of the plurality of openings, that is, an equal number and an even number of openings for supply and openings for collection are provided as described above, temperature distribution excessively increases, thereby becoming a cause of unevenness of an image formed by liquid ejection.

An object of the present invention is to provide a liquid ejecting head and a liquid ejecting apparatus that have a configuration where an equal number and an even number of a plurality of different types of openings which communicates with a flow passage connected to pressure chambers are provided, maintain the strength of bonding of an element substrate where the openings are provided, and restrain temperature distribution.

Hereinafter, a liquid ejecting head, a liquid ejecting apparatus and a liquid ejecting method according to embodiments of the present invention will be described with reference to FIGS. 1A to 17. The liquid ejecting head and the liquid ejecting apparatus of the present invention are able to be applied to apparatuses such as a printer, a copier, a facsimile machine having a communication system and a word processor having a printer unit, and to an industrial recording apparatus combined in manifold ways with various types of processing devices. For example, the liquid ejecting head and the liquid ejecting apparatus are also able to be used for applications such as biochip manufacturing and electronic circuit printing. In addition, although a thermal system in which bubbles are generated by a heating element so as to eject a liquid is adopted in the embodiments below, the present invention is able to be applied also to a liquid ejecting head in which a piezoelectric system and other various types of liquid ejecting systems are adopted.

Although the liquid ejecting apparatus of the embodiments is an ink jet recording apparatus (recording apparatus) in a form of circulating a liquid such as an ink between an ink tank and the liquid ejecting head, other forms may be adopted. For example, a form, in which an ink in a pressure chamber is caused to flow in by providing two tanks on an upstream side and a downstream side of the liquid ejecting head and causing the ink to flow from one ink tank to the other ink tank instead of circulating the ink, may be adopted. In addition, although the liquid ejecting head of the embodiments is a so-called line type head having a length corresponding to a width of a recording medium, the present invention is able to be applied to a so-called serial type liquid ejecting head that performs recording while performing scanning with respect to a recording medium. An example of the serial type liquid ejecting head includes a configuration where one element substrate is loaded for each of a black ink and a colored ink. Without being limited thereto, however, a form in which a plurality of element substrates is disposed to overlap an ejection orifice in an ejection orifice line direction, a short line head that is shorter than a width of a recording medium is created, and the line head is caused to scan the recording medium may be adopted.

As described above, since the embodiments to be described below are appropriate specific examples of the present invention, a variety of technically suitable limitations are attached. However, the present invention is not limited to the embodiment and other specific methods of the present disclosure insofar as the idea of the present invention is kept.

(Structure of Element Substrate of Liquid ejecting Head)

Figure 1B:
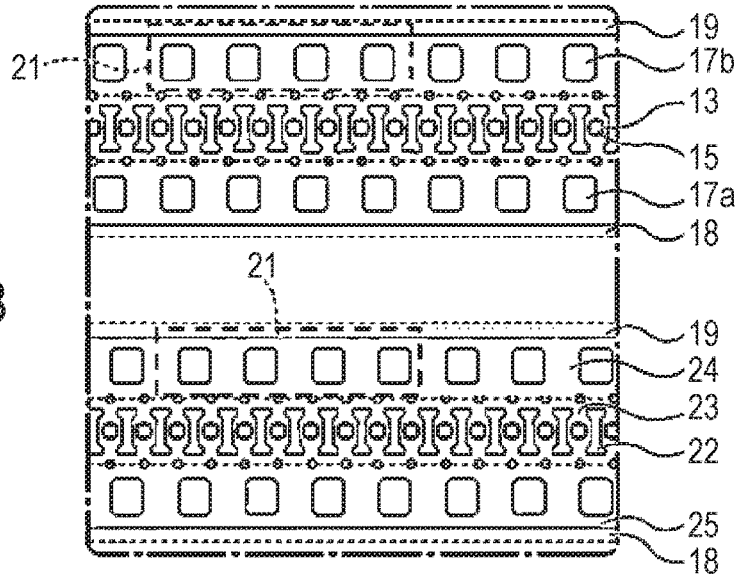
Figure 1C:
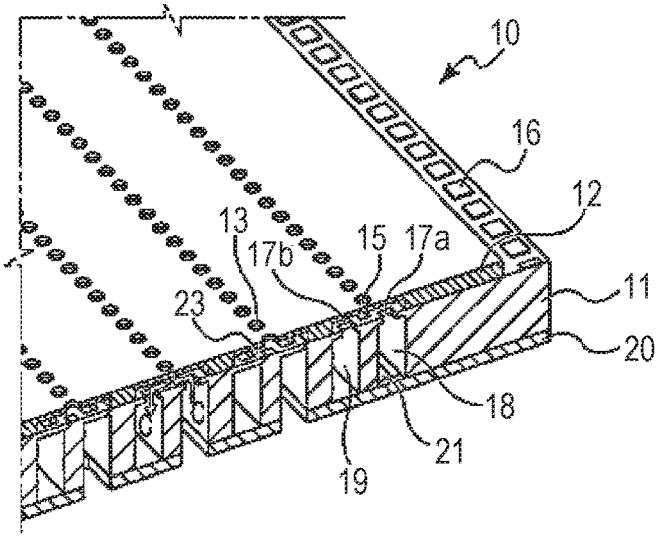

A structure of an element substrate 10, which is a main characteristic portion of the liquid ejecting head of the embodiment of the present invention will be described. FIG. 1A is a plan view illustrating a surface on a side where ejection orifices 13 of the element substrate 10 are formed (ejection orifice formed surface). FIG. 1B is an enlarged view of a portion A of FIG. 1A. FIG. 1C is a perspective view taken along line B-B of FIG. 1A. As illustrated in FIG. 1A, a plurality of ejection orifice lines 14 corresponding to each ink color is formed to be arranged in an ejection orifice formed member 12 of the element substrate 10. A direction where the ejection orifice lines 14, each of which includes the plurality of ejection orifices 13, extend will be called "ejection orifice line direction". Although the element substrate 10 of which a planar shape is rectangular is illustrated as an example in FIG. 1A, the planar shape of the element substrate 10 is not limited, and may be, for example, a parallelogrammic shape. As illustrated in FIG. 1B, for example, an energy generating element 15, which is a heating element for foaming a liquid by thermal energy, is disposed at a position corresponding to each of the ejection orifices 13. A partition wall 22 partitions pressure chambers 23 that each include the energy generating element 15 therein. The energy generating element 15 is electrically connected to a terminal 16 illustrated in FIG. 1A by electrical wiring (not illustrated) provided in the element substrate 10. The energy generating element 15 generates heat to boil a liquid in the pressure chamber 23 based on a pulse signal input from a control circuit (not illustrated) via an electrical wiring substrate and a flexible wiring substrate. Power of foam generated by the boiling causes the liquid to be ejected from the ejection orifices 13 to the outside. As illustrated in FIG. 1B, a supply flow passage (first flow passage) 18 and a collecting flow passage (second flow passage) 19 are disposed on one side and the other side, respectively, with each of the ejection orifice lines 14 interposed therebetween, and extend along the ejection orifice lines 14. The supply flow passage 18 and the collecting flow passage 19 are liquid flow passages that are provided in the element substrate 10 and extend in the ejection orifice line direction, and communicate with the pressure chamber 23 and the ejection orifice 13 via a supply orifice 17*a* and a collecting orifice 17*b*, respectively.

Figure 2:
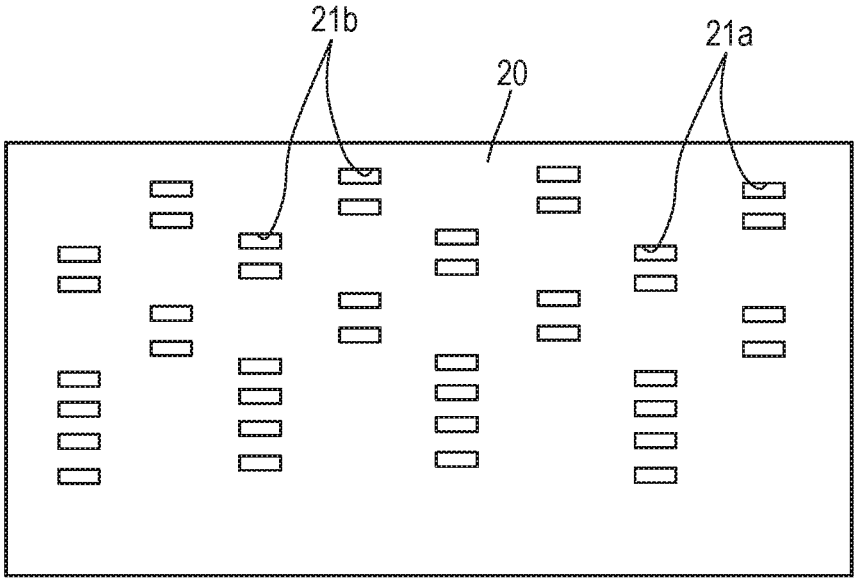
FIG. 2 is a rear view of a lid member of the element substrate illustrated in FIGS. 1A to 1C.

As illustrated in FIG. 1C, the element substrate 10 is formed by laminating the ejection orifice formed member 12 in which the ejection orifices 13 are formed and a sheet-like lid member 20 illustrated in FIG. 2 onto both surfaces of a substrate 11. A plurality of openings 21 each of which communicates with the supply flow passage 18 and the collecting flow passage 19 is provided in the lid member 20. In the embodiment, two openings (first openings) 21*a* for one supply flow passage 18 and two openings (second openings) 21*b* for one collecting flow passage 19 are respectively provided in the lid member 20. As illustrated in FIG. 1B, the openings 21 of the lid member 20 respectively communicate with a plurality of liquid communication orifices 31 of a supporting member 30 bonded to a surface on an opposite side to the ejection orifice formed member 12 of the substrate 11 via the lid member 20, as will be described below (refer to FIGS. 5A and 5B). As illustrated in FIG. 1C, the lid member 20 has a function as a lid forming a part of a wall of the supply flow passage 18 and the collecting flow passage 19 formed in the substrate 11. The lid member 20 can have sufficient corrosion resistance to a liquid. In addition, an opening shape and an opening position of each opening 21 require high accuracy from a perspective of color mixing prevention. For this reason, the openings 21 can be provided through a photographic process using a photosensitive resin material and a silicon plate as a material for the lid member 20. As described above, the lid member 20 converts a flow passage pitch by the openings 21, can have a small thickness when considering a pressure loss, and can be formed of a film-like member.

Next, the flow of a liquid in the element substrate 10 will be described. As illustrated in FIG. 1C, the element substrate 10 has a multilayer structure in which the ejection orifice formed member 12 formed of a photosensitive resin is laminated on one surface of the substrate 11 formed of Si and the lid member 20 is bonded to the other surface thereof. The energy generating elements 15 (refer to FIG. 1B) are formed on the one surface of the substrate 11, and grooves forming the supply flow passages 18 and the collecting flow passages 19, which extend along an ejection orifice line are formed in the other surface. The supply flow passages 18 and the collecting flow passages 19, which are formed by the substrate 11 and the lid member 20, are respectively connected to common supply flow passages 211 and common collecting flow passages 212 (refer to FIG. 7) which are in a flow passage member 210 to be described below. A liquid pressure difference (differential pressure) is generated between the supply flow passage 18 and the collecting flow passage 19.

When a liquid is ejected from the plurality of ejection orifices 13 of the liquid ejecting head 3 to perform recording, the flow of the liquid is generated in the ejection orifices 13 that do not perform an ejection operation due to a differential pressure between the supply flow passage 18 and the collecting flow passage 19. Specifically, a liquid in the supply flow passages 18 provided in the substrate 11 flows to the collecting flow passages 19 via the supply orifices 17*a*, the pressure chambers 23 and the collecting orifices 17*b* as illustrated with an arrow C of FIG. 1C. In a case where a liquid (thickened ink) that is thickened by evaporation of moisture from the ejection orifices 13, foam or foreign substances exist in the vicinity of the ejection orifices 13, which have suspended recording, or inside the pressure chambers 23, the liquid, the foam or the foreign substances are able to be put on the flow described above and to be collected toward the collecting flow passages 19. In addition, the thickening of a liquid in the vicinity of the ejection orifices 13 or inside the pressure chambers 23 is able to be suppressed.

As will be described below, the liquid collected toward the collecting flow passages 19 flows to the outside of liquid ejecting modules 200 (refer to FIG. 12) from the openings 21 of the lid member 20 via the liquid communication orifices 31 (refer to FIGS. 5A and 5B) of the supporting member 30. Then, the liquid passes through, in this order, communication orifices 51, an individual collecting flow passage 214 and the common collecting flow passage 212, which are in the flow passage member 210, and is collected toward the supply flow passage of the recording apparatus in the end. However, all the liquids flowed in from one end of the common supply flow passage 211 is not supplied to the pressure chamber 23 via an individual supply flow passage 213, and some of the liquids flow out from the other end of the common supply flow passage 211 instead of flowing into the individual supply flow passage 213. By having a path that allows flowing without going through the element substrate 10 in this manner, reverse flow of liquid circulating flow is able to be suppressed even in a case of including the element substrate 10 that includes a fine flow passage with high flow resistance as in the embodiment. Therefore, since the thickening of a liquid in the vicinity of the pressure chamber or the ejection orifices is able to be suppressed in the liquid ejecting head of the embodiment, misdirection of ejection or non-ejection is able to be suppressed, and consequently high-quality recording is able to be performed.

First Embodiment

Figure 3A:
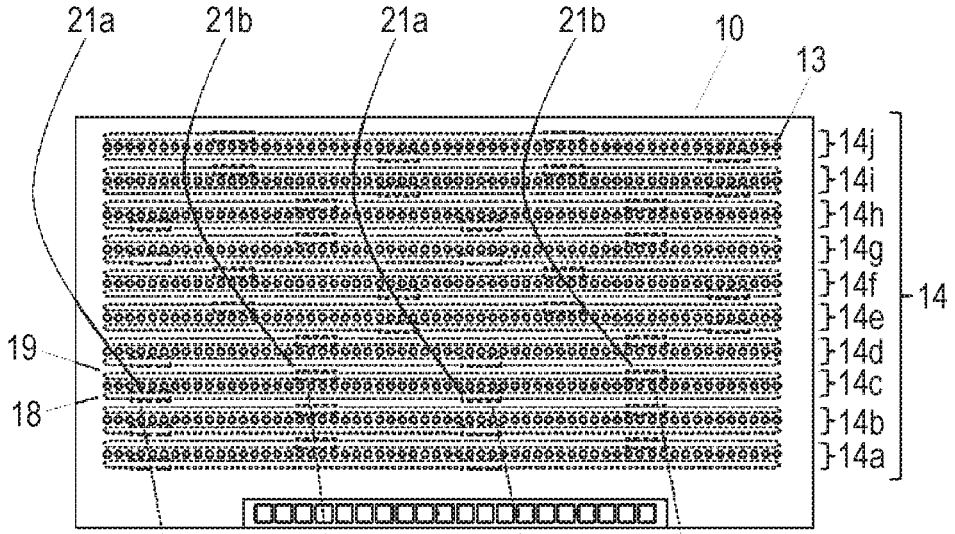
FIGS. 3A, 3B and 3C are a plan view of an element substrate according to a comparative example, a graph schematically illustrating a relationship between a position and a temperature of the element substrate and a graph illustrating a result of temperature calculation.
Figure 3B:
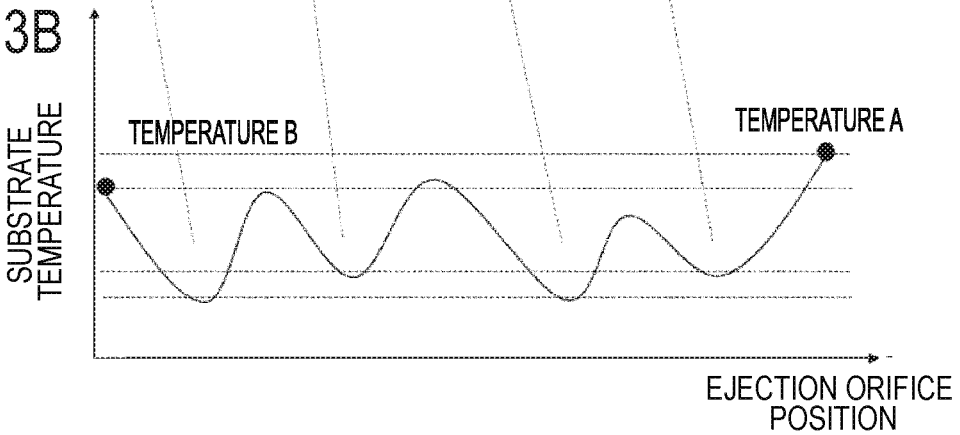
Figure 3C:
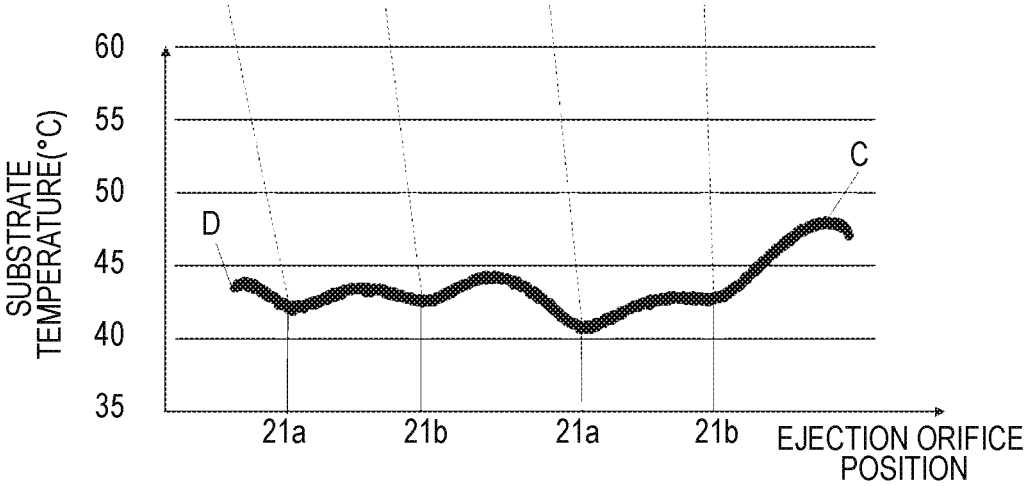

Herein, main characteristics of the present invention will be described while comparing to a comparative example with reference to FIGS. 3A to 4C. FIGS. 3A to 3C are schematic views illustrating a relationship between a position of each of the openings 21 of the lid member 20 and a temperature of each portion of the element substrate 10 with one ejection orifice line 14*c*, out of a plurality of ejection orifice lines 14*a* to 14*j* provided on the element substrate 10 of the comparative example, given as an example. As illustrated in FIG. 3A, openings for supply 21*a* of the supply flow passage 18 and openings for collection 21*b* of the collecting flow passage 19 are alternately disposed along the ejection orifice line direction in the comparative example. In a case where flow from the supply flow passage 18 to the collecting flow passage 19 via the pressure chamber 23 is generated, the liquid collects heat generated from the energy generating element 15, which is a heating element, in general. Thus, a temperature of a liquid on a collecting flow passage side, which flows out from the pressure chamber 23, is high.

The amount of a liquid ink ejected from the plurality of ejection orifices 13 is larger than the flow rate of a liquid ink supplied to the pressure chambers 23 according to an image to be formed in some cases. At this time, the liquid ink is supplied to the pressure chambers 23 also from the collecting flow passage side via the openings for collection 21*b*. That is, when forming an image by using the multiple ejection orifices 13, a high-temperature liquid ink is supplied from the collecting flow passage side in some cases. Accordingly, a temperature near the openings for collection 21*b* of the element substrate 10 is higher than a temperature near the openings for supply 21*a* in some cases, and thereby unevenness occurs in an image to be formed due to an effect of temperature distribution. In a case where there are an equal number and an even number of the openings for supply 21*a* and the openings for collection 21*b* and the openings for supply 21*a* and the openings for collection 21*b* are alternately disposed, the openings for supply 21*a* are disposed in the vicinity of one end part of the element substrate 10 in the ejection orifice line direction, and the openings for collection 21*b* are disposed in the vicinity of the other end part. For this reason, as illustrated in a schematic graph of temperature distribution of FIG. 3B, a difference between a temperature A of an end part on a side where the openings for collection 21*b* are disposed and a temperature B of an end part on a side where the openings for supply 21*a* are disposed is large. When such large temperature distribution is generated, a temperature difference between the element substrates 10 adjacent to each other is remarkable, and a possibility that large image unevenness which is highly visible occurs is high, in particular, in a line type liquid ejecting head formed by the plurality of element substrates 10 being disposed side by side along the ejection orifice line direction.

Figure 4A:
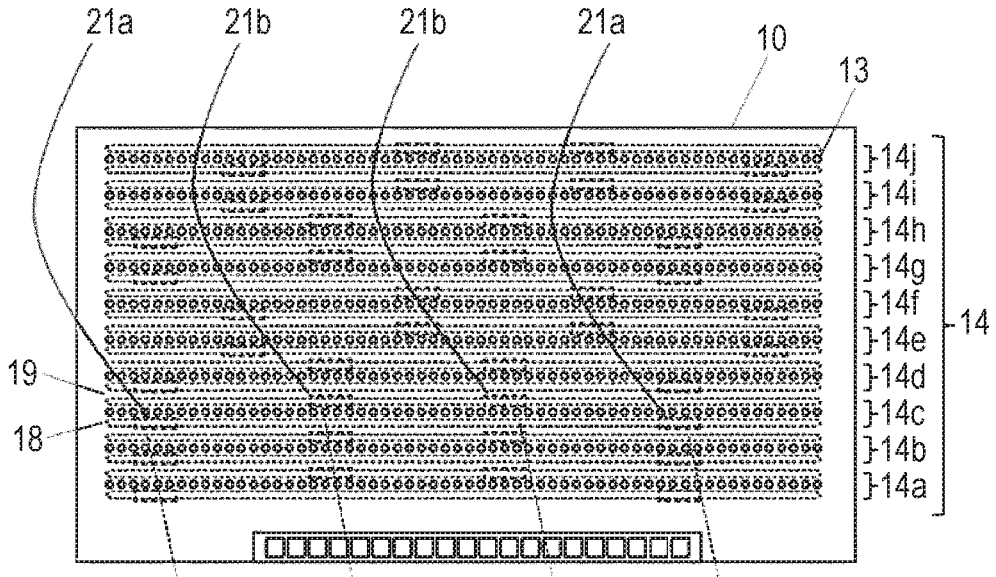
FIGS. 4A, 4B and 4C are a plan view of the element substrate illustrated in FIGS. 1A to 1C, a graph schematically illustrating a relationship between a position and a temperature of the element substrate and a graph illustrating a result of temperature calculation.
Figure 4B:
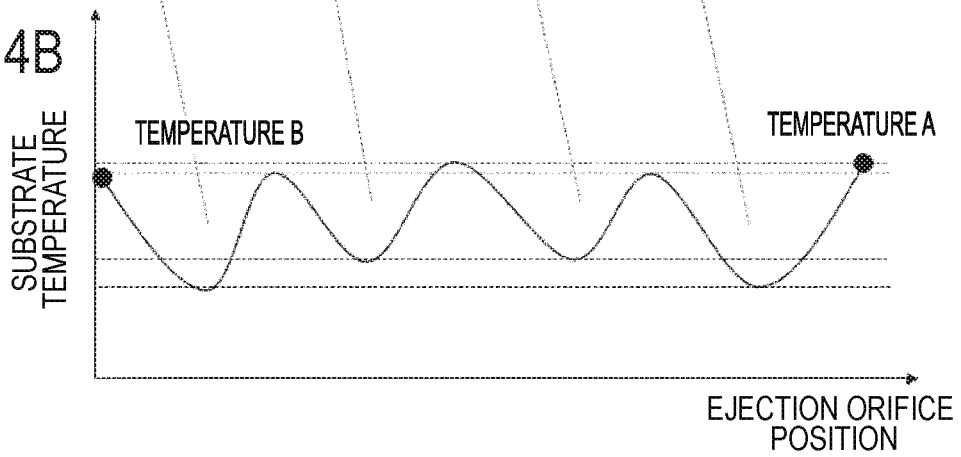

On the contrary, the openings for supply 21*a* are respectively disposed near both end parts of the element substrate 10 in the ejection orifice line direction, and two openings for collection 21*b* are disposed side by side between the openings for supply 21*a* in the ejection orifice line direction in the embodiment of the present invention illustrated in FIG. 4A. In other words, both openings positioned at both ends in the ejection orifice line direction are the openings for supply 21*a*, out of the plurality of openings for supply 21*a* and the plurality of openings for collection 21*b*. By disposing in this manner, a difference between the temperature A of one end part and the temperature B of the other end part is small as illustrated in FIG. 4B since the same type of openings (the openings for supply 21*a* in the embodiment) are respectively disposed in the vicinity of one end part and in the vicinity of the other end part of the element substrate 10 in the ejection orifice line direction. Therefore, even in a case where the plurality of element substrates 10 is disposed side by side, a temperature difference between the element substrates 10 adjacent to each other is small, and image unevenness attributable to the temperature difference is able to be restrained to an extent that the image unevenness is hardly visible. In addition, an excessive temperature rise is able to be made unlikely to occur even near the ejection orifices 13 at positions far from the openings for supply 21*a* by disposing the openings for supply 21*a* in the vicinity of both end parts in the ejection orifice line direction. As a result, also a temperature difference in the element substrate 10 is able to be decreased, and a more uniform image with low unevenness is able to be formed.

Results of actually performing specific temperature calculation for temperature distribution of the comparative example illustrated in FIG. 3B are illustrated in FIG. 3C. That is, temperature calculation is performed for a case where temperature control is performed to keep the element substrate 10 illustrated in FIG. 3A at 40° C., an image pattern with a large ejection amount is formed, and the flow rate of a liquid circulating through the pressure chamber 23 is higher than the flow rate of a liquid ejected from the ejection orifices 13. A relationship between positions of the opening for supply 21*a* and the opening for collection 21*b* and a temperature of the element substrate 10, which is acquired through the temperature calculation, is illustrated in FIG. 3C. The calculation results illustrated in FIG. 3C also show that temperatures of the openings for collection 21*b* tend to be higher than temperatures of the openings for supply 21*a* as in the schematic graph of FIG. 3B. In particular, a temperature rise is large from the openings for collection 21*b* disposed in the vicinity of a substrate end part to the substrate end part. Therefore, a temperature rise at a position C of the ejection orifice 13 at an end part far from the openings for collection 21*b* is large, and a temperature difference at a position D of the ejection orifice 13 at an end part of the element substrate 10 on an opposite side is approximately 4.2° C. An image formed by liquid ejection from the element substrate 10 with such a large temperature difference has a high possibility that large image unevenness which is highly visible occurs. Since a large temperature difference of 4.2° C. is generated between the end parts of the element substrates adjacent to each other in the line type liquid ejecting head formed by disposing such element substrates 10 side by side, large image unevenness which is highly visible is likely to occur in particular. In addition, a difference between a maximum temperature and a minimum temperature inside the same element substrate 10 is 7.2° C., and large image unevenness which is highly visible is likely to occur also inside an image formed by one element substrate 10.

Figure 4C:
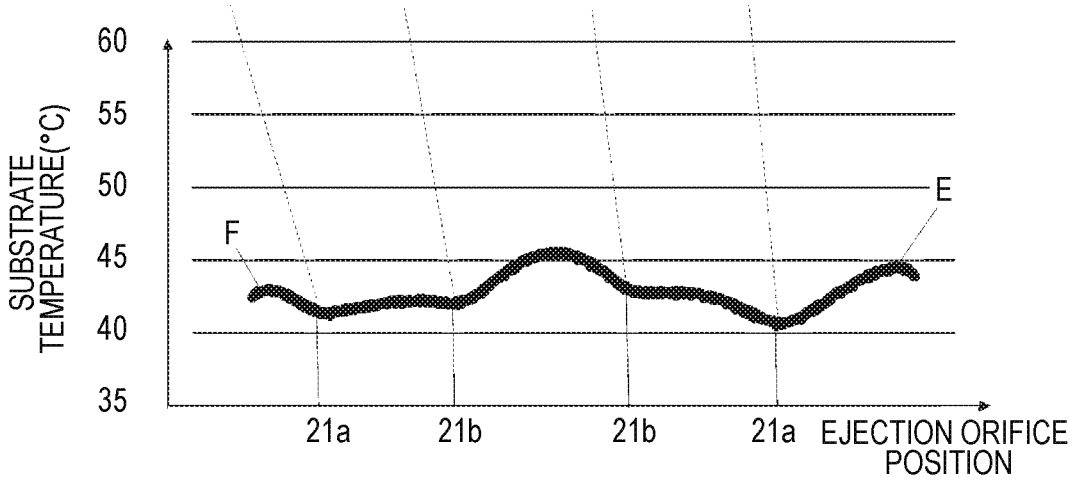

Results of actually performing specific temperature calculation for temperature distribution of the present invention illustrated in FIG. 4B are illustrated in FIG. 4C. As in the comparative example illustrated in FIG. 3C, a relationship between positions of the opening for supply 21*a* and the opening for collection 21*b* and the temperature of the element substrate 10 in a case where temperature control is performed to keep the element substrate 10 at 40° C. is illustrated in FIG. 4C. The calculation results illustrated in FIG. 4C also show that the temperature of the element substrate 10 at the positions of the openings for supply 21*a* is low and the temperature of the element substrate 10 at the positions of the openings for collection 21*b* is high as in the schematic graph of FIG. 4B. A temperature of the element substrate 10 at a position E of the ejection orifice 13 at the end part far from the openings is lower than the temperature at the position C of the comparative example illustrated in FIG. 3C. That is, an excessive temperature rise is able to be suppressed by positioning the openings for supply 21*a* at both end parts of the element substrate 10. A temperature difference between the position E and a position F of the ejection orifice 13 at the end part of the element substrate 10 on the opposite side is small, which is approximately 1.5° C. Since the temperature difference is small as described above, the image unevenness of the image formed by liquid ejection from the element substrate 10 is small, and large image unevenness which is highly visible is unlikely to occur. A temperature difference between the end parts of the element substrate 10 adjacent to each other is small, which is approximately 1.5° C., in the line type liquid ejecting head formed by disposing such element substrates 10 side by side. Therefore, unevenness of an image to be formed is able to be restrained to be small. A difference between a maximum temperature and a minimum temperature inside the same element substrate 10 is 4.5° C., which is smaller than the comparative example illustrated in FIG. 3C, and image unevenness is able to be restrained also inside an image formed by one element substrate 10.

To restrain a temperature difference between the end parts by further restraining a temperature rise in the end parts of the element substrate 10, opening widths of the openings for supply 21*a*, which are disposed at both end parts, can be widened in the ejection orifice line direction. However, by widening the opening widths, an interval between the openings adjacent to each other becomes short, and thus there is a possibility that the reliability of adhesion between the element substrate 10 and the lid member 20 decreases. Thus, an adhered area can be better maintained by narrowing the opening widths of the openings for collection 21*b* in the ejection orifice line direction.

Figure 5A:
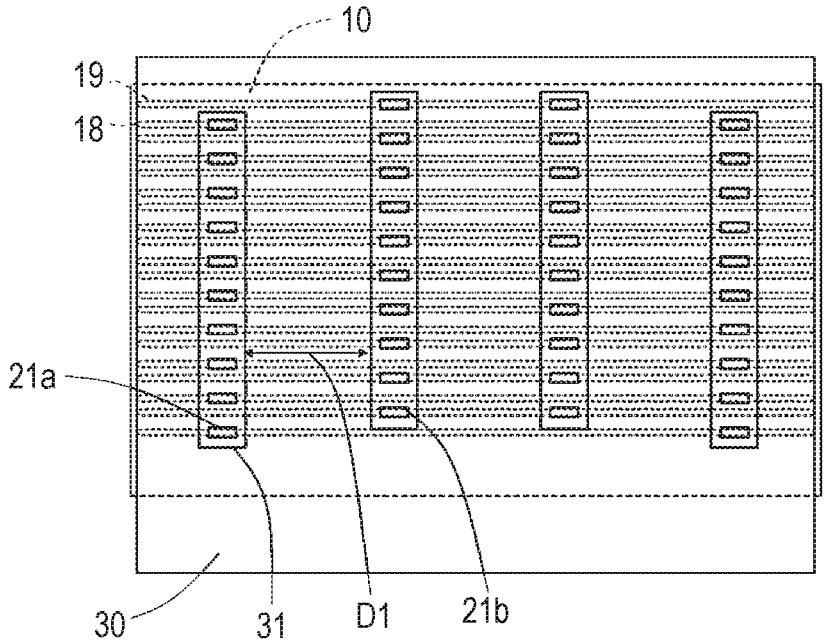
FIGS. 5A and 5B are plan views illustrating an example of disposition of an element substrate according to a first embodiment of the present invention and an opening and a communication orifice of a supporting member.
Figure 5B:
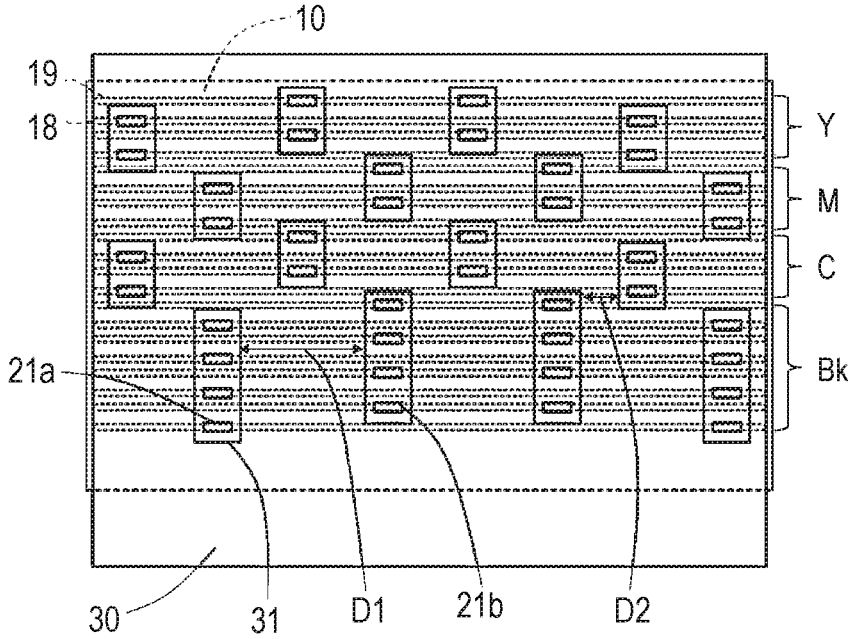

Adhesion between the element substrate 10 having such openings 21 and the supporting member 30 will be described. FIG. 5A illustrates a state where the embodiment is adopted in a case where one type of liquid is supplied to the element substrate 10. FIG. 5B illustrates a state where the embodiment is adopted in a case where a plurality of types of liquids is supplied to the element substrate 10. FIGS. 5A and 5B are views of the supporting member 30 seen from an opposite side of an adhered surface with the element substrate 10. A length of the element substrate 10 in the ejection orifice line direction is set to 22.3 mm (0.88 inches), and lengths of the supply flow passage 18 and the collecting flow passage 19 in the ejection orifice line direction are set to 21.9 mm Dimensions (opening widths) of the openings 21*a* and 21*b* of the lid member 20 in the ejection orifice line direction are set to 0.9 mm, and dimensions (opening widths) of the liquid communication orifices 31 of the supporting member 30, which communicate with the openings 21*a* and 21*b*, in the ejection orifice line direction are set to 1.5 mm.

As illustrated in FIG. 5A, two openings 21*a* and 21*b* of the supply flow passage 18 and the collecting flow passage 19 are respectively provided at equal intervals in a configuration where one type of liquid is supplied to the element substrate 10. A distance D1 of this case between the liquid communication orifices 31, which communicate with the openings 21*a* and 21*b*, respectively, and are adjacent to each other, is 3.98 mm, and the distance is an adhesion width. The adhesion width can be wider in order to improve the reliability of adhesion. When the number of the openings 21 having the same dimension increases by one, the adhesion width becomes 2.88 mm, and the distance becomes approximately 72% of the distance before the increase in the number of openings. Widening the adhesion width by making the dimensions of the openings 21 and the liquid communication orifices 31 in the ejection orifice line direction smaller and making the distance between the openings 21 adjacent to each other longer is considered. However, there is a limit to making the dimensions of the liquid communication orifices 31 smaller depending on a material of the supporting member 30, and the adhesion width is not able to be made excessively long. A material that has high flatness and allows the supporting member to be bonded to the element substrate 10 with high reliability can be suitable for the supporting member 30. The supporting member 30 made of, for example, alumina and a resin member can be used. In a case of forming the liquid communication orifices 31 in the supporting member 30 formed of such a material, it is necessary for the opening width to be approximately 1 mm or more and for the distance between the liquid communication orifices 31 adjacent to each other to be approximately 1 mm or more as well. Accordingly, in order to make the adhesion width 1 mm or more, it is sufficient for the number of openings per one ejection orifice line to be 10 or less.

As illustrated in FIG. 5B, in a case where liquids having multiple colors including black, cyan, magenta and yellow (Bk, C, M and Y) are supplied to the element substrate 10, not only the distance D1 between the liquid communication orifices 31 for the same color but also a distance D2 between the liquid communication orifices 31 for different colors adjacent to each other are significant. In order to make the distance (adhesion width) 1 mm or more as in the configuration illustrated in FIG. 5A, it is sufficient for the number of openings per one ejection orifice line to be 5 or less. However, it is desirable for the adhesion width to be larger than 1 mm in some cases according to a material for adhesive and adhesion accuracy. In such a case, adhesion reliability can be improved by decreasing the number of openings and widening the adhesion width.

(Structure of Liquid ejecting Apparatus)

Figure 6:
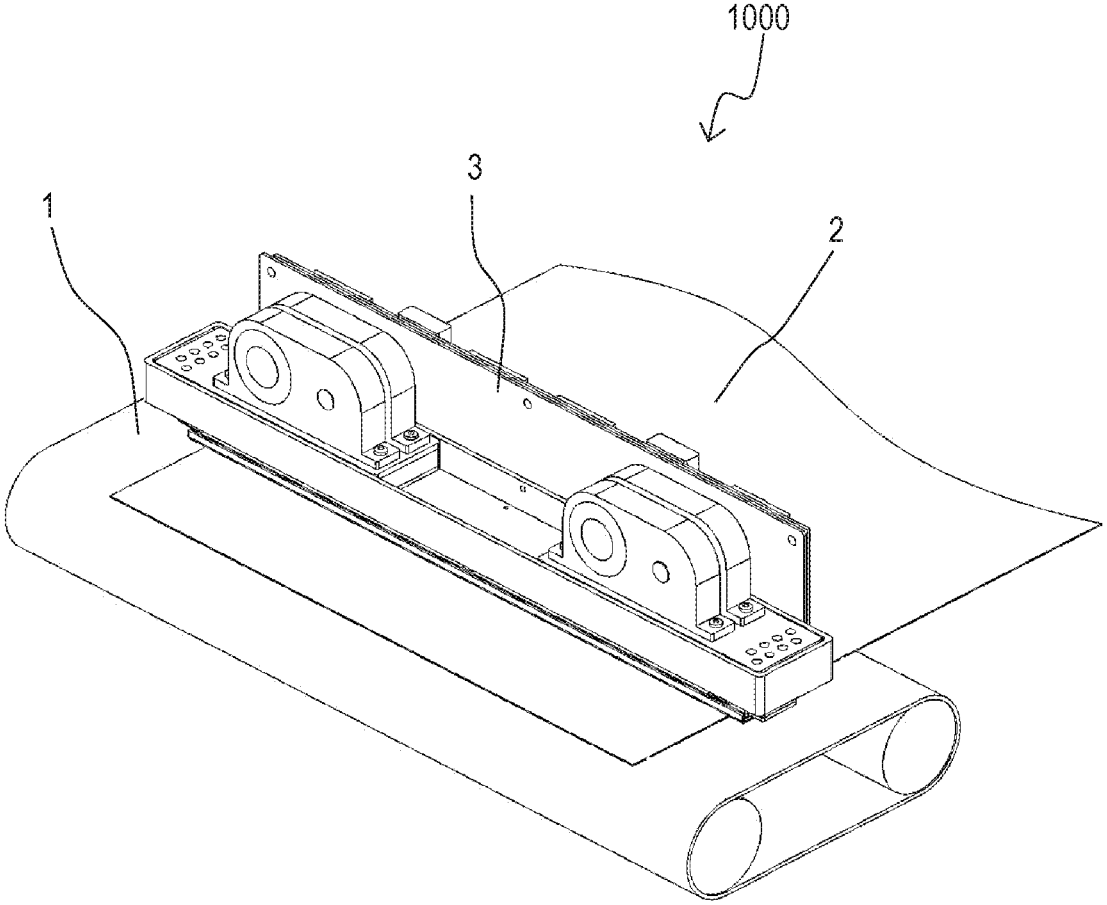
FIG. 6 is a perspective view illustrating important parts of a liquid ejecting apparatus including the liquid ejecting head of the present invention.

Details of an example of the liquid ejecting apparatus including the liquid ejecting head, which includes the element substrate 10, the lid member 20 and the supporting member 30 described above will be described. FIG. 6 illustrates the liquid ejecting apparatus of the present invention, and in particular, a schematic configuration of an ink jet recording apparatus 1000 (hereinafter, also referred to as a recording apparatus) that ejects an ink to perform recording. The recording apparatus 1000 includes a transporting unit 1 that transports a recording medium 2 and the line type (pagewide side) liquid ejecting head 3 disposed to be substantially orthogonal to a transporting direction of the recording medium. The recording apparatus 1000 is a line type recording apparatus that performs continuous recording in a single pass while continuously or intermittently transporting the plurality of recording target media 2. Without being limited to cut paper, the recording medium 2 may be continuous rolled paper. The liquid ejecting head 3 is capable of performing full-color printing with CMYK (cyan, magenta, yellow and black) inks. That is because two ink tanks (a main tank 1006 and a buffer tank 1003) (refer to FIG. 7) are fluidly connected to a liquid supply unit, which is a supply passage for supplying a liquid to the liquid ejecting head, as will be described below. In addition, an electric control unit that transmits power and an ejection control signal to the liquid ejecting head 3 is electrically connected to the liquid ejecting head 3. A liquid path and an electric signal path in the liquid ejecting head 3 will be described below.

As illustrated in FIGS. 1A to 1C, the energy generating elements 15 are provided on the element substrate 10 in the liquid ejecting head 3. An individual supply flow passage including the supply orifice 17*a* that supplies a liquid ink to the pressure chamber 23 which accommodates the energy generating element 15 and an individual collecting flow passage including the collecting orifice 17*b* for collecting a liquid ink in the pressure chamber 23 are formed in the element substrate 10. The ejection orifices 13 that communicate with the pressure chambers 23 are formed in the ejection orifice formed member 12. As described above, the plurality of individual supply flow passages and the plurality of individual collecting flow passages are formed in the element substrate 10, and the plurality of pressure chambers 23 is disposed therebetween. The partition wall 22 partition each of the pressure chambers 23, the energy generating element 15 is assigned therein, and the ejection orifice 13 is formed at a position facing the energy generating element 15. Although a heating element that is capable of generating thermal energy is given as an example of the energy generating element 15, the present invention is not limited thereto. For example, an electromechanical conversion element such as a piezoelectric element or various types of other elements that generate energy for ejecting are adoptable.

A pulse signal input to the terminal 16 from a control circuit of the recording apparatus 1000 via an electrical wiring substrate 90 and a flexible wiring substrate 40 (refer to FIG. 8A) is transmitted to the energy generating elements 15 via the electrical wiring (not illustrated). Accordingly, the energy generating elements 15 are selectively driven according to recording data, and a desired amount of liquid ink is ejected from the ejection orifices 13. In a case where the energy generating elements 15 are in a suspended state, a liquid ink is collected toward the outside of the element substrate 10 via the individual collecting flow passages from the collecting orifices 17*b* after the liquid ink is supplied to the pressure chambers 23 from the supply orifices 17*a* of the individual supply flow passages. In the embodiment, such flow (circulating flow) of the liquid ink is generated when the energy generating elements 15 are not driven, and the circulating flow is kept being generated continuously also when the energy generating elements 15 are driven to eject the liquid ink. That is, the liquid ink is ejected by the driving of the energy generating elements 15 in a state where the liquid ink in the pressure chambers 23 flows.

(First Circulation Path)

Figure 7:
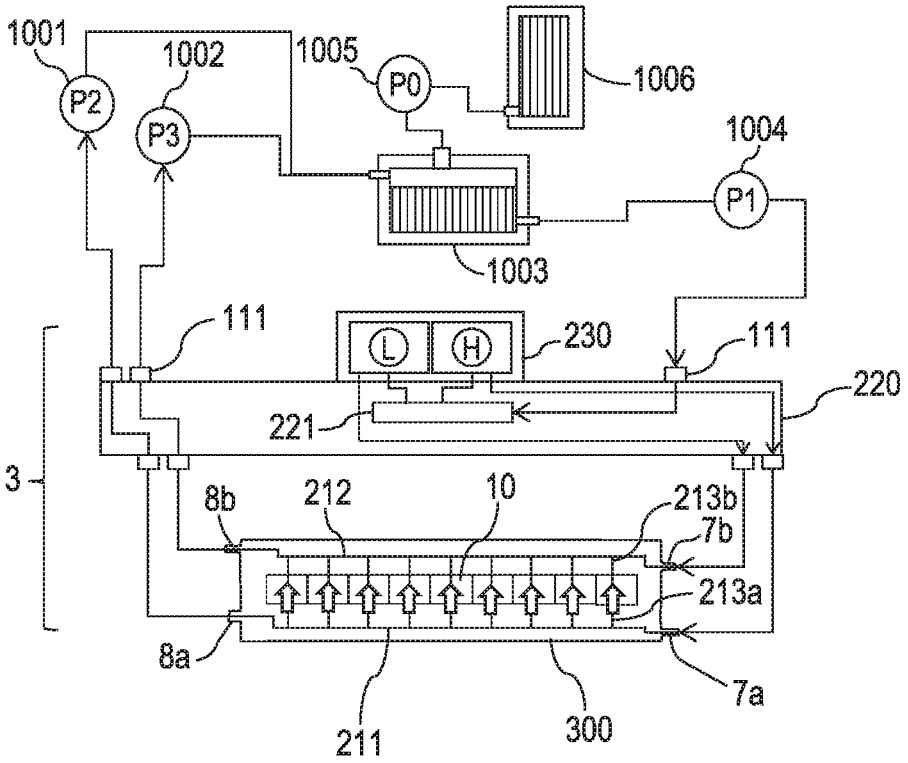
FIG. 7 is a schematic view illustrating a first circulation path of the liquid ejecting apparatus illustrated in FIG. 6.

FIG. 7 is a schematic view illustrating an example of the entire configuration of a flow passage system of such a liquid ejecting apparatus (first circulation path). A state where the liquid ejecting head 3 is fluidly connected to a first circulation pump (high-pressure side) 1001, a first circulation pump (low-pressure side) 1002 and the buffer tank 1003 is illustrated in FIG. 7. Although only a path through which one color of ink flows is illustrated in FIG. 7 in order to simplify description, circulation paths that correspond to an actually necessary number of colors are provided in the liquid ejecting head 3 and the recording apparatus main body. The buffer tank 1003, which is connected to the main tank 1006 and is a sub tank, has an air communication orifice (not illustrated) that allows the inside of the tank to communicate with the outside, and is capable of discharging bubbles in an ink to the outside. The buffer tank 1003 is also connected to a replenishing pump 1005. When the liquid ejecting head 3 consumes a liquid by ejecting (discharging) the ink from the ejection orifices of the liquid ejecting head, such as recording and suction recovery by ink ejection, the replenishing pump 1005 delivers the consumed amount of ink from the main tank 1006 to the buffer tank 1003.

The two first circulation pumps 1001 and 1002 are for sucking the liquid from a liquid connecting unit 111 of the liquid ejecting head 3 and flowing the liquid to the buffer tank 1003. A positive displacement pump having a quantitative liquid delivery performance can be used as the first circulation pump. Specifically, although examples of the first circulation pumps include a tube pump, a gear pump, a diaphragm pump and a syringe pump, for example, a form, in which a pump outlet is assigned with a general constant flow valve or a general relief valve and constant flow rate is secured, may be adopted. When the liquid ejecting head 3 is driven, a certain amount of ink flows in the common supply flow passages 211 and the common collecting flow passages 212 by the first circulation pump (high-pressure side) 1001 and the first circulation pump (low-pressure side) 1002, respectively.

A negative pressure control unit 230 is provided in a path between a second circulation pump 1004 and a liquid ejection unit 300. The negative pressure control unit has a function of operating to maintain a pressure on a downstream side (that is, a liquid ejection unit 300 side) of the negative pressure control unit 230 at a certain pressure set in advance even in a case where flow rate in a circulation system has fluctuated according to a difference in duty of performing recording. Any mechanisms may be used as two pressure controlling mechanisms forming the negative pressure control unit 230 insofar as each mechanism is capable of controlling a pressure on the downstream side such that fluctuations of the pressure stay equal to and less than a certain range based on a desired set pressure. The same mechanism as a so-called "decompression regulator" is adoptable as an example. Since adopting such a configuration allows suppressing an effect of a water head pressure of the buffer tank 1003 on the liquid ejecting head 3, a degree of freedom in layout of the buffer tank 1003 in the recording apparatus 1000 is able to be improved.

A pump having a lifting pressure that is equal to or higher than a certain pressure in a range of circulating flow rate of an ink used when driving the liquid ejecting head 3 may be used as the second circulation pump 1004, and a turbo pump and a positive displacement pump are able to be used as the second circulation pump. Specifically, a diaphragm pump is adoptable. In addition, instead of the second circulation pump 1004, for example, also a hydraulic head tank that is disposed with a certain hydraulic head difference compared to the negative pressure control unit 230 is adoptable. By having one pump on a side where an ink is supplied to the liquid ejecting head 3 as described above, a total pump number in the apparatus is able to be reduced, and thus an apparatus size is able to be made smaller.

As illustrated in FIG. 7, the negative pressure control unit 230 includes two pressure controlling mechanisms in which control pressures different from each other are set. A relative high-pressure setting side (written as H in FIG. 7) and a relative low-pressure setting side (written as L in FIG. 7), which are in two negative pressure controlling mechanisms, are respectively connected to the common supply flow passage 211 and the common collecting flow passage 212 in the liquid ejection unit 300 via a liquid supply unit 220. The liquid ejection unit 300 is provided with the common supply flow passage 211, the common collecting flow passages 212, and individual supply flow passages 213*a* and individual collecting flow passages 213*b* that communicate with each element substrate. A first inflow orifice and a first collecting orifice are formed in the common supply flow passage 211. A first inflow orifice 7*a* is fluidly connected to the pressure controlling mechanism H, and a first collecting orifice 8*a* is fluidly connected to the first circulation pump (first collecting pump) 1001. A second inflow orifice 7*b* and a second collecting orifice 8*b* are formed in the common collecting flow passage 212. The second inflow orifice 7*b* is fluidly connected to the pressure controlling mechanism L, and the second collecting orifice 8*b* is fluidly connected to the first circulation pump (second collecting pump) 1002. At this time, when a pressure value in the vicinity of the first inflow orifice 7*a* in the common supply flow passage is set as Pu_i, a pressure value in the vicinity of the first collecting orifice 8*a* is set as Pu_o, a pressure value in the vicinity of the second inflow orifice 7*b* in the common collecting flow passage is set as Pd_i, and a pressure value in the vicinity of the second collecting orifice 8*b* is set as Pd_o, the following inequalities are satisfied.

$$Pu_i > Pd_i \qquad \text{Inequality 1}$$

$$Pu_o > Pd_o \qquad \text{Inequality 2}$$

Since the pressure controlling mechanism H is connected to the common supply flow passage 211 and the pressure controlling mechanism L is connected to the common collecting flow passage 212, a differential pressure is generated between the two common flow passages, thereby satisfying Inequality 1. In addition, the first circulation pumps 1001 and 1002 allow a constant amount of ink that satisfies Inequality 2 to flow inside the common supply flow passage and the common collecting flow passage.

By adopting the configuration, the flow (white arrows of FIG. 7) of an ink that passes through the individual supply flow passages 213*a* from the common supply flow passage 211, passes through the individual collecting flow passages 213*b* via the plurality of pressure chambers in the element substrate, and reaches the common collecting flow passage 212 is generated with respect to each element substrate. Flow reaching the collecting orifices is simultaneously generated in respective common flow passages instead of an ink supplied from the two inflow orifices going through each element substrate. For this reason, even in a case where an ink is supplied at relatively high flow rate, an increase in a pressure loss of the supply flow passage inside the liquid ejecting head 3 is able to be suppressed, and the flow of an ink in the pressure chambers 23 that do not perform ejection is able to be generated. Therefore, flow in the common supply flow passage 211 and flow in the common collecting flow passage 212 allow heat generated by each element substrate 10 to be discharged to the outside of the liquid ejecting head 3. In addition, since the flow of an ink is able to be generated also in the ejection orifices or the pressure chambers regardless of an operation state, the thickening of the ink in that part is able to be suppressed. In addition, a thickened ink and foreign substances in the ink are able to be discharged to the common collecting flow passage 212. For this reason, the liquid ejecting head 3 of the embodiment is capable of performing high-quality recording at a high speed.

(Description of Head Configuration)

Figure 8A:
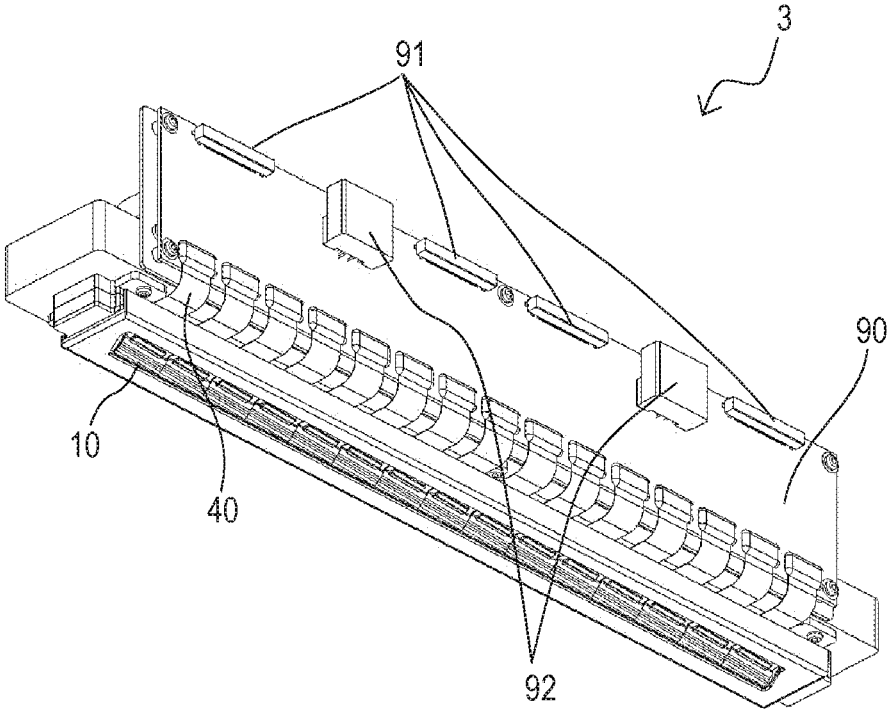
FIGS. 8A and 8B are perspective views illustrating the liquid ejecting head of the liquid ejecting apparatus illustrated in FIG. 6.
Figure 8B:
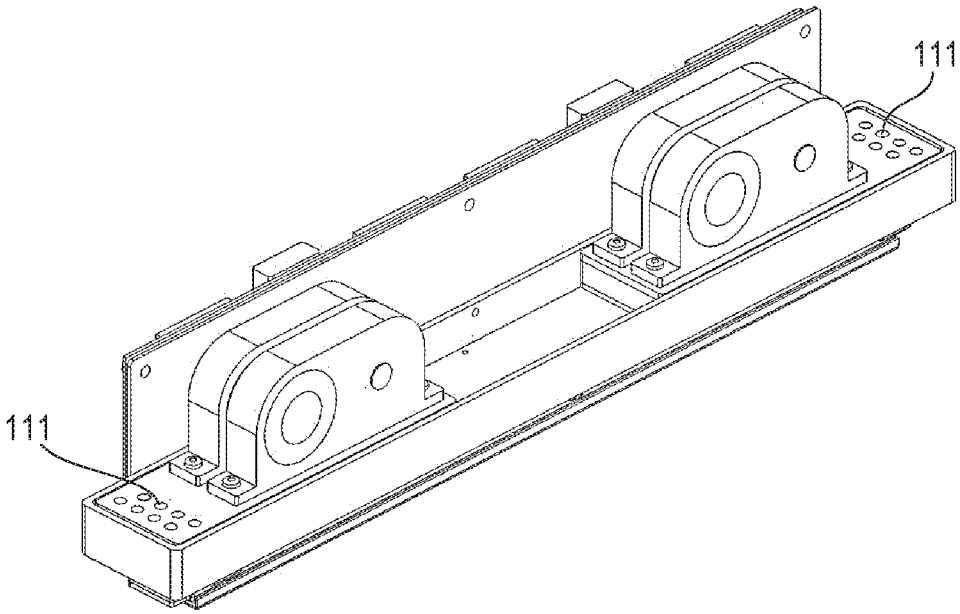

A configuration of the liquid ejecting head 3 according to the first embodiment will be described. FIGS. 8A and 8B are perspective views of the liquid ejecting head 3 according to the embodiment. The liquid ejecting head 3 is a line type liquid ejecting head in which 15 element substrates 10, each of which is capable of ejecting inks having four colors including C/M/Y/K, are linearly arrayed (disposed inline). The plurality of element substrates 10 each provided with the ejection orifices 13, the pressure chambers 23, the energy generating elements 15, the supply flow passages 18 and the collecting flow passages 19 illustrated in FIGS. 1A to 1C is disposed side by side to form a line. A dimension of the liquid ejecting head 3 in a width direction (practically matches the ejection orifice line direction in general) orthogonal to the transporting direction of the recording medium 2 by the transporting unit 1 illustrated in FIG. 6 is equal to or larger than a dimension of the recording medium 2 in the width direction. As illustrated in FIG. 8A, the liquid ejecting head 3 includes each of the element substrates 10, and signal input terminals 91 and power supply terminals 92, which are electrically connected to each other via the flexible wiring substrate 40 and the electrical wiring substrate 90. The signal input terminals 91 and the power supply terminals 92 are electrically connected to a control unit of the recording apparatus 1000, and respectively supply an ejection drive signal and power necessary for ejection to the element substrates 10. By integrating wiring with an electric circuit in the electrical wiring substrate 90, the number of the signal input terminals 91 and the number of the power supply terminals 92 are able to be made small compared to the number of the element substrates 10. Accordingly, the number of electric connecting units that are necessary to be removed from the recording apparatus 1000 when assembling the liquid ejecting head 3 or when replacing the liquid ejecting head is small. As illustrated in FIG. 8B, the liquid connecting units 111 provided at both end parts of the liquid ejecting head 3 are connected to a liquid supply system of the recording apparatus 1000. Accordingly, inks having four colors including CMYK are supplied from the supply system of the recording apparatus 1000 to the liquid ejecting head 3, and the inks which have passed through the liquid ejecting head 3 are collected toward the supply system of the recording apparatus 1000. In this manner, each color of ink is capable of circulating via a path of the recording apparatus 1000 and a path of the liquid ejecting head 3.

Figure 9:
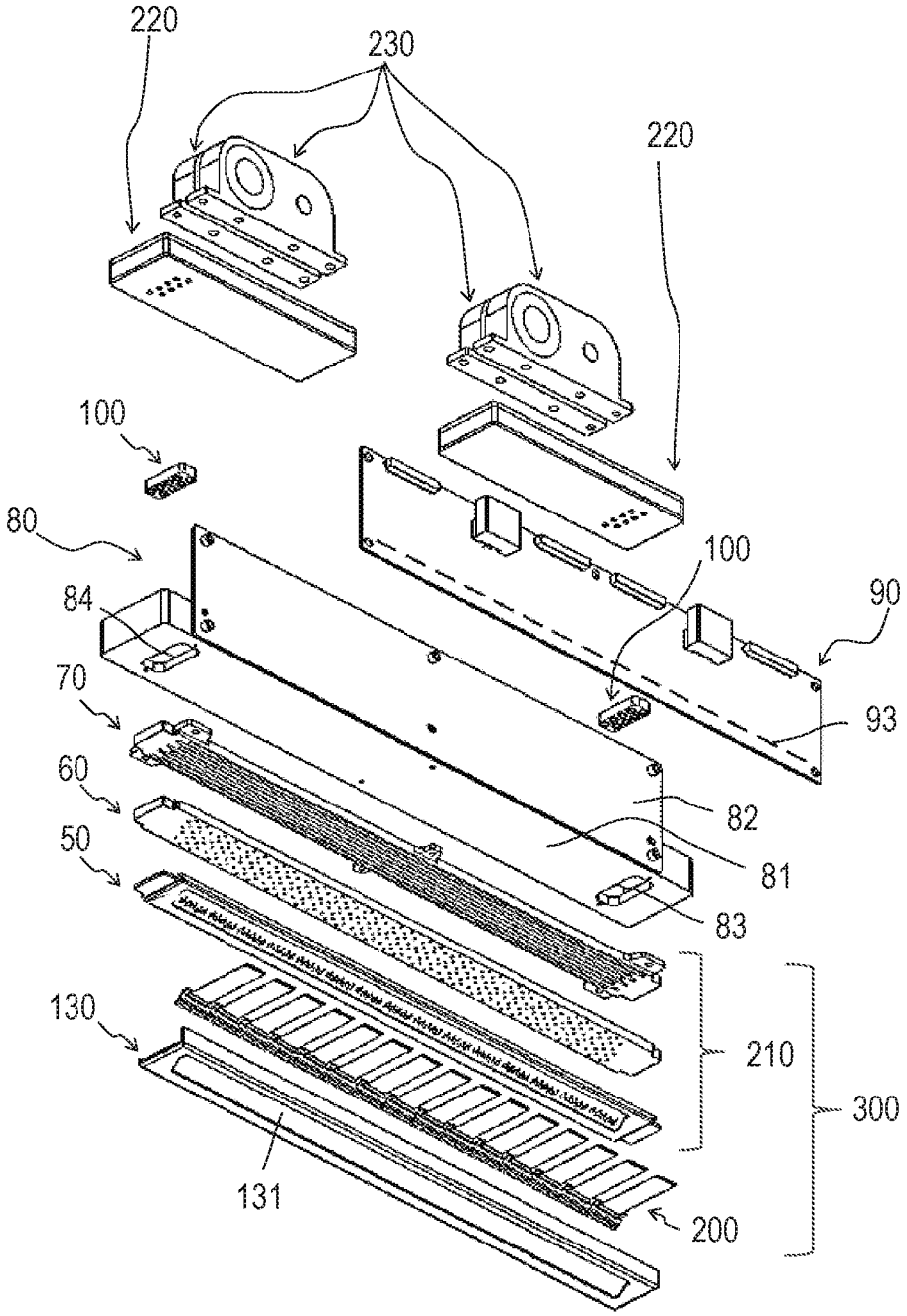
FIG. 9 is an exploded perspective view of the liquid ejecting head illustrated in FIGS. 8A and 8B.

FIG. 9 is an exploded perspective view of each component or each unit forming the liquid ejecting head 3. The liquid ejection unit 300, the liquid supply units 220, and the electrical wiring substrate 90 are attached to a housing 80. The liquid supply unit 220 is provided with the liquid connecting unit 111 (refer to FIG. 8B). As illustrated in FIG. 7, since foreign substances in a supplied ink are removed inside the liquid supply unit 220, a filter 221 for each color which communicates with each of openings of the liquid connecting units 111 is provided. A liquid, which has passed through the filter 221, is supplied to the negative pressure control unit 230 which is disposed to correspond to each color on the liquid supply unit 220.

Next, a configuration of the flow passage member 210 included in the liquid ejection unit 300 will be described. As illustrated in FIG. 9, the flow passage member 210 is a laminate of three flow passage members (a first flow passage member 50, a second flow passage member 60 and a third flow passage member 70). The flow passage member 210 is a flow passage member for distributing a liquid supplied from the liquid supply units 220 to each liquid ejecting module 200 and for returning a liquid refluxing from each liquid ejecting module 200 to the liquid supply units 220. The flow passage member 210 is fixed to a liquid ejection unit supporting unit 81 through screwing, and accordingly, the warping and deformation of the flow passage member 210 is suppressed. FIGS. 10A to 10F are exploded views for facilitating the understanding of a flow passage unit of the flow passage member 210. FIG. 10A illustrates a surface of the first flow passage member 50 on a side where the liquid ejecting modules 200 are loaded. FIG. 10B illustrates a surface on an opposite side thereto. FIG. 10C illustrates a surface of the second flow passage member 60 on a side where the first flow passage member 50 is bonded. FIG. 10D illustrates a surface on an opposite side thereto. FIG. 10E illustrates a surface of the third flow passage member 70 on a side where the second flow passage member 60 is bonded. FIG. 10F illustrates a surface on an opposite side thereto, which is a surface on a side abutting against the liquid ejection unit supporting unit 81. Eight common flow passages extending in a longitudinal direction of the flow passage member are the common supply flow passages 211 for respective colors and the common collecting flow passages 212 for respective colors. Each of the inflow orifices 7*a* and 7*b* and each of the collecting orifices 8*a* and 8*b* (refer to FIG. 7) communicate with each hole of joint rubber 100 (refer to FIG. 9), and are fluidly connected to the liquid supply units 220. The plurality of individual supply flow passages 213 is formed in the flow passage member 210 in a direction intersecting the common flow passages, and the flow passage member is fluidly connected to the plurality of liquid ejecting modules 200. The flow passage member 210 can be formed of a material that has corrosion resistance to a liquid and has a low linear expansion coefficient. For example, a composite material (resin material) to which mineral fillers such as silica particles and fibers are added with alumina, a liquid crystal polymer (LCP), polyphenylene sulfide (PPS) or polysulfone (PSF) as a base material is suitable as a material for the flow passage member 210.

Figure 11:
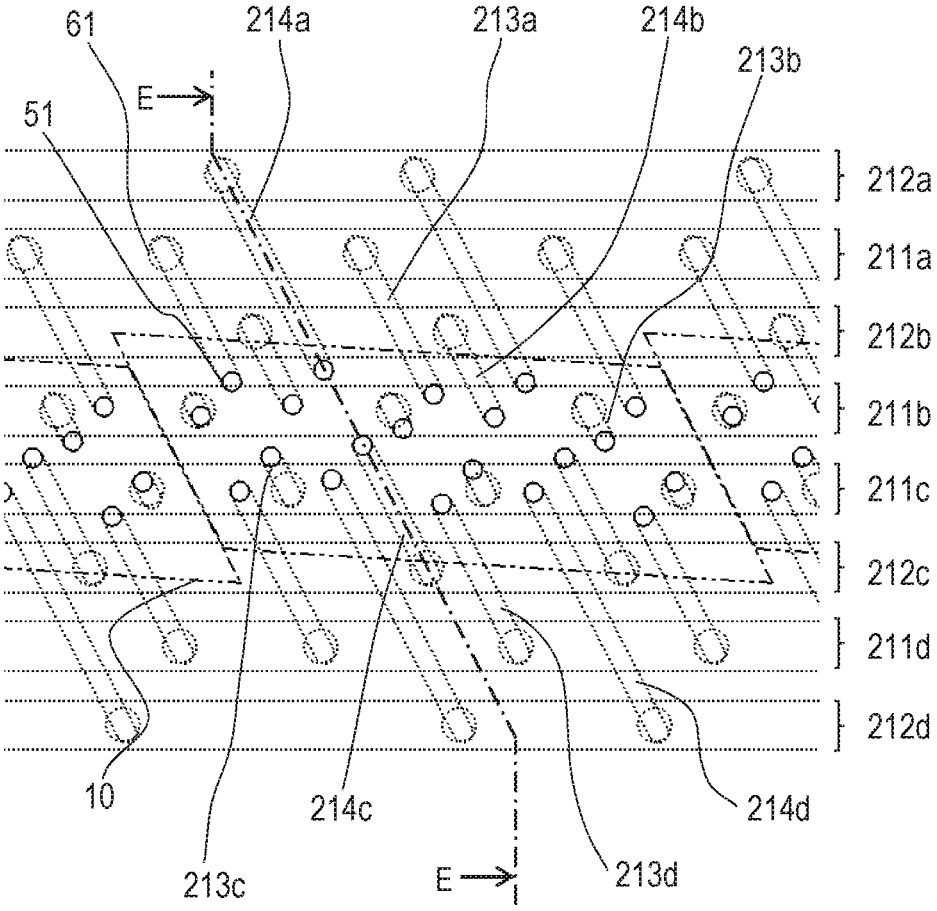
FIG. 11 is an enlarged plan view schematically illustrating a part of each flow passage member illustrated in FIGS. 10A to 10F.

Next, a connection relationship between respective flow passages in the flow passage member 210 will be described with reference to FIG. 11. FIG. 11 is an enlarged perspective view of some of the flow passages in the flow passage member 210 seen from a side of a surface where the liquid ejecting modules 200 are loaded. The flow passage member 210 is provided with, for each color, the common supply flow passages 211 (211*a*, 211*b*, 211*c* and 211*d*) and the common collecting flow passages 212 (212*a*, 212*b*, 212*c* and 212*d*), which extend in a longitudinal direction of the liquid ejecting head 3. The individual supply flow passages 213*a* are connected to the common supply flow passage 211 for each color via a communication orifice 61. In addition, the plurality of individual collecting flow passages 213*b* is connected to the common collecting flow passage 212 for each color via the communication orifice 61. Such a flow passage configuration allows an ink to be concentrated on the element substrate 10 positioned at a center part of the flow passage member from each common supply flow passage 211 via the individual supply flow passages 213*a*. In addition, the flow passage configuration allows the ink to be collected at each common collecting flow passage 212 from the element substrate 10 via the individual collecting flow passages 213*b*.

Figure 12:
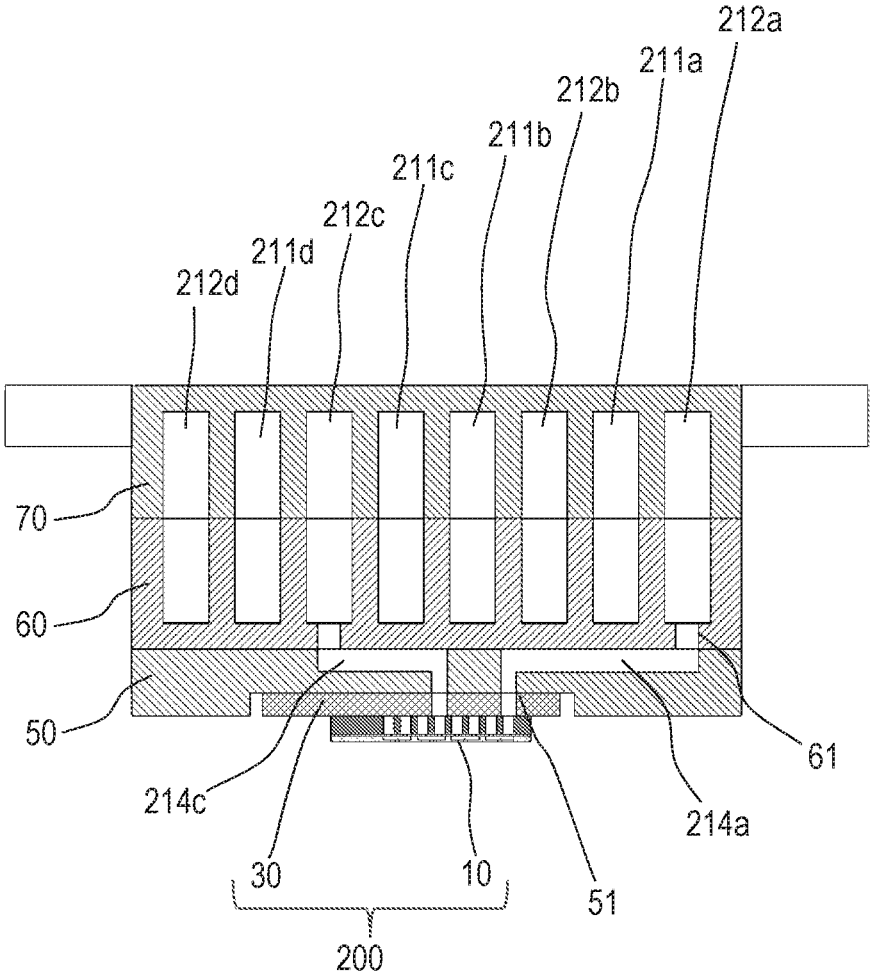
FIG. 12 is a sectional view taken along line E-E of FIG. 11.

FIG. 12 is a view illustrating a section taken along line E-E of FIG. 11. Although individual collecting flow passages 214*a* and 214*c* are illustrated in FIG. 12, other individual collecting flow passages 214*b* and 214*d* and the individual supply flow passages 213*a* to 213*d* communicate with the liquid ejecting modules 200 in another section. The plurality of supply orifices 17*a* and the plurality of collecting orifices 17*b* are formed in the element substrate 10 included in each liquid ejecting module 200, the individual supply flow passages 213*a* to 214*d* are fluidly connected to the supply orifices 17*a*, respectively, and the individual collecting flow passages 214*a* to 214*d* are fluidly connected to the collecting orifices 17*b*, respectively.

Figure 13A:
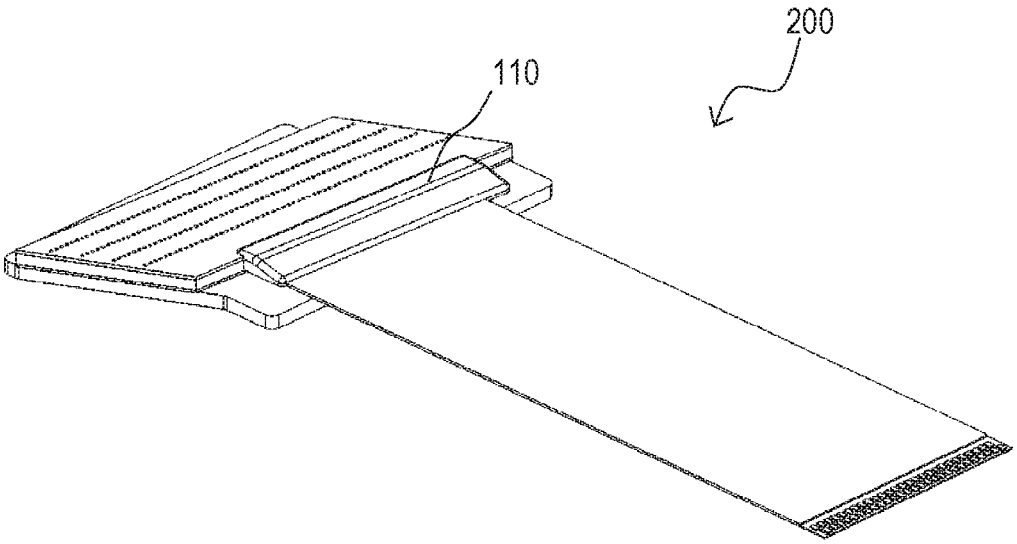
FIGS. 13A and 13B are a perspective view and an exploded perspective view, which illustrate a liquid ejecting module of the liquid ejecting head illustrated in FIGS. 8A to 9.
Figure 13B:
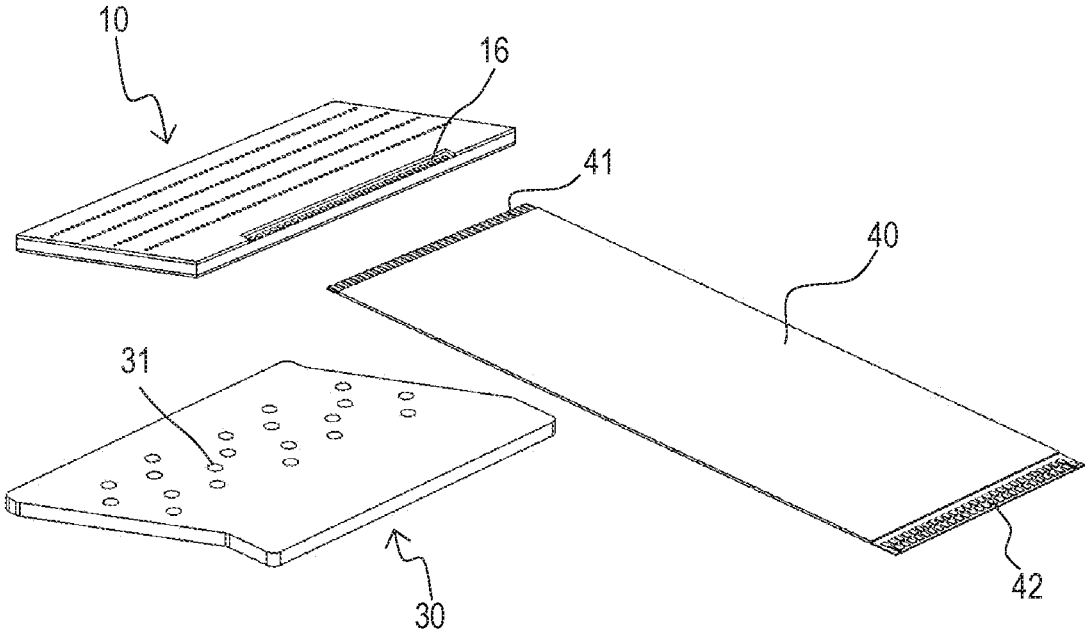
Figure 14A:
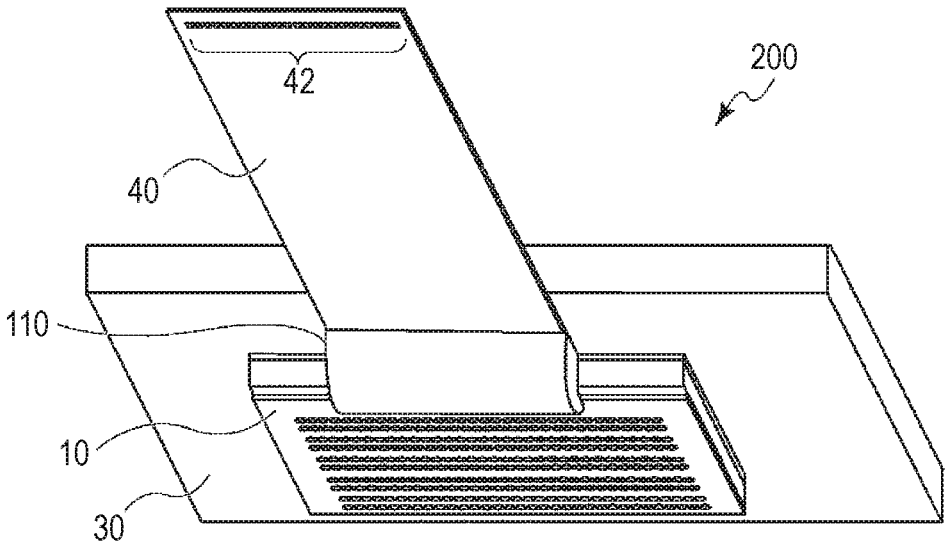
FIGS. 14A and 14B are a perspective view and an exploded perspective view of the liquid ejecting module of the liquid ejecting head illustrated in FIGS. 8A to 9, which are seen from angles different from FIGS. 13A and 13B.
Figure 14B:
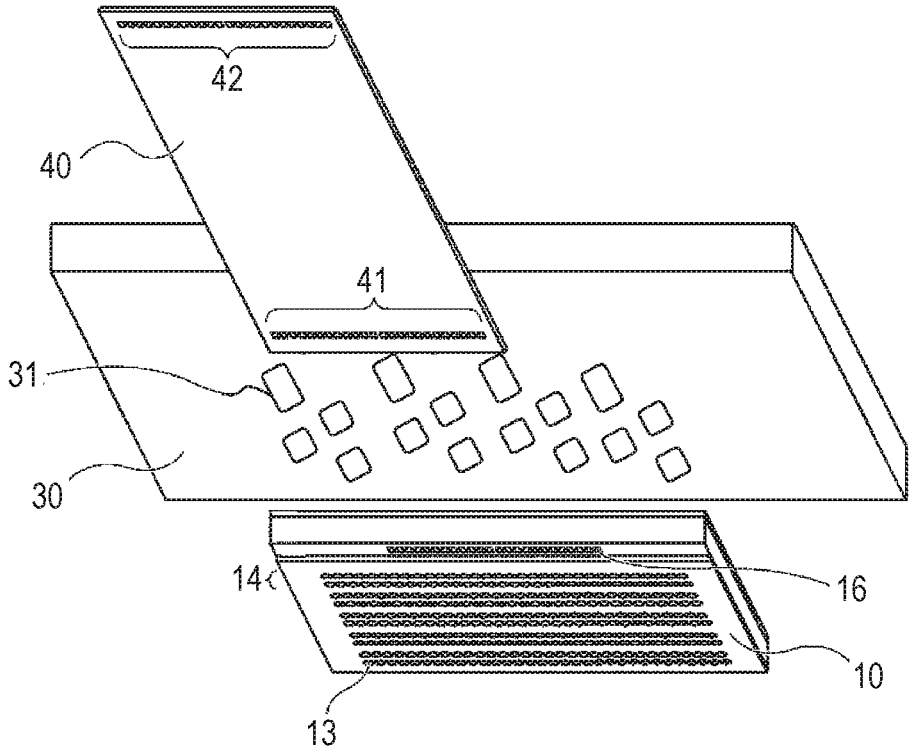

FIGS. 13A and 14A are perspective views of the liquid ejecting module 200 of the liquid ejecting apparatus of such an embodiment. FIGS. 13B and 14B are partially exploded perspective views of the liquid ejecting module. The liquid ejecting module 200 has a configuration where the element substrate 10 and the flexible wiring substrate 40 are disposed on the supporting member 30. The terminal 16 of the element substrate 10 and a terminal 41 of the flexible wiring substrate 40 are electrically connected to each other through a metal wire (not illustrated), and an electric connecting unit therebetween is covered and protected by a sealant 110. The liquid communication orifices 31 that supply an ink, which is a liquid ejected from the liquid ejecting module 200, to the element substrate 10 are formed in the supporting member 30. A terminal 42 of the flexible wiring substrate 40, which is on an opposite side to the element substrate 10, is electrically connected to a connection terminal 93 (refer to FIG. 9) of the electrical wiring substrate 90. Since the supporting member 30 is a supporting body that supports the element substrate 10 and is a flow passage member that allows the element substrate 10 and the flow passage member 210 to fluidly communicate with each other, a member that has high flatness and is capable of being bonded to the element substrate with sufficiently high reliability can be used as the supporting member. As a material for the supporting member, for example, alumina and a resin material can be used. The supporting member may be formed to have a lamination configuration including a first supporting member in which a supply flow passage and a collecting flow passage are formed and a second supporting member in which a common supply flow passage and a common collecting flow passage are formed. In this case, at least the thermal diffusivity of the first supporting member is lower than the thermal diffusivity of the element substrate.

As described above, liquid ejection (recording) from the liquid ejecting head 3 is able to be performed by generating liquid flow that circulates through the inside of the pressure chambers 23 illustrated in FIGS. 1A to 1C, and liquid flow is able to be generated also in the pressure chambers 23 that do not eject the liquid (do not perform recording) in the embodiment. Accordingly, the thickening of a liquid inside the pressure chambers 23, in particular, in the vicinity of the ejection orifices 13 is able to be suppressed. Even when the thickening of a liquid or the mixing of a liquid with foreign substances occurs, the thickened liquid or the foreign substances are able to be put on circulating flow to be discharged to the outside of the liquid ejecting modules 200. For this reason, the liquid ejecting head 3 of the embodiment is capable of performing high-quality recording at a higher speed.

Next, the flow of a liquid in the liquid ejecting apparatus of the embodiment will be described. First, a liquid flows into the liquid ejecting head 3 from the liquid connecting units 111 of the liquid supply units 220 illustrated in FIGS. 7 to 9. Then, the liquid is supplied to communication orifices 72 and common flow passage grooves 71 of the third flow passage member 70, common flow passage grooves 62 and the communication orifices 61 of the second flow passage member 60 and individual flow passage grooves 52 and the communication orifices 51 of the first flow passage member 50, which are illustrated in FIGS. 10A to 10F, in this order from the joint rubber 100. After then, the liquid is supplied to the pressure chambers 23 via the liquid communication orifices 31 provided in the supporting member 30, the openings 21 provided in the lid member 20 and the supply flow passages 18 and the supply orifices 17*a*, which are provided in the substrate 11, in this order, as illustrated in FIGS. 1A to 5B. When the liquid is ejected from some of the ejection orifices 13 to perform recording, in the ejection orifices 13 that do not perform an ejection operation, the liquid in the supply flow passages 18 flows to the collecting flow passage 19 via the supply orifices 17*a*, the pressure chambers 23 and the collecting orifices 17*b* due to a differential pressure between the supply flow passage 18 and the collecting flow passage 19. The liquid which is supplied to the pressure chambers 23 and is not ejected from the ejection orifices 13 in this manner flows in the collecting orifices 17*b* and the collecting flow passage 19, which are provided in the substrate 11, the openings 21 provided in the lid member 20 and the liquid communication orifices 31 provided in the supporting member 30, in this order. After then, the liquid flows in the communication orifices 51 and the individual flow passage grooves 52, which are provided in the first flow passage member 50, the communication orifices 61 and the common flow passage grooves 62, which are provided in the second flow passage member 60, the common flow passage grooves 71 and the communication orifices 72, which are provided in the third flow passage member 70, and the joint rubber 100, in this order. The liquid flows to the outside of the liquid ejecting head 3 from the liquid connecting units 111 provided in the liquid supply units 220. This flow allows a thickened liquid inside the pressure chambers 23, foam or foreign substances to be collected toward the collecting flow passage 19. In addition, the thickening of a liquid inside or in the vicinity of the ejection orifices 13 or the pressure chambers 23 is able to be suppressed. Accordingly, misdirection of ejection or non-ejection is able to be suppressed, and consequently, high-quality recording is able to be performed. In addition, since reverse flow to the common collecting flow passage 212 is able to be suppressed regardless of a drive state of each element substrate 10 and a fluctuation range of circulating (supply) flow rate is able to be suppressed, a head configuration that allows maintaining circulating flow, which enables securing an effect of circulation, is adopted in the embodiment. Although the pressure controlling mechanism is adopted as a pressure generation source in the embodiment, the present invention is not limited thereto. For example, a hydraulic head difference control configuration enabled by a water level sensor may be adopted.

(Second Circulation Path)

Figure 15:
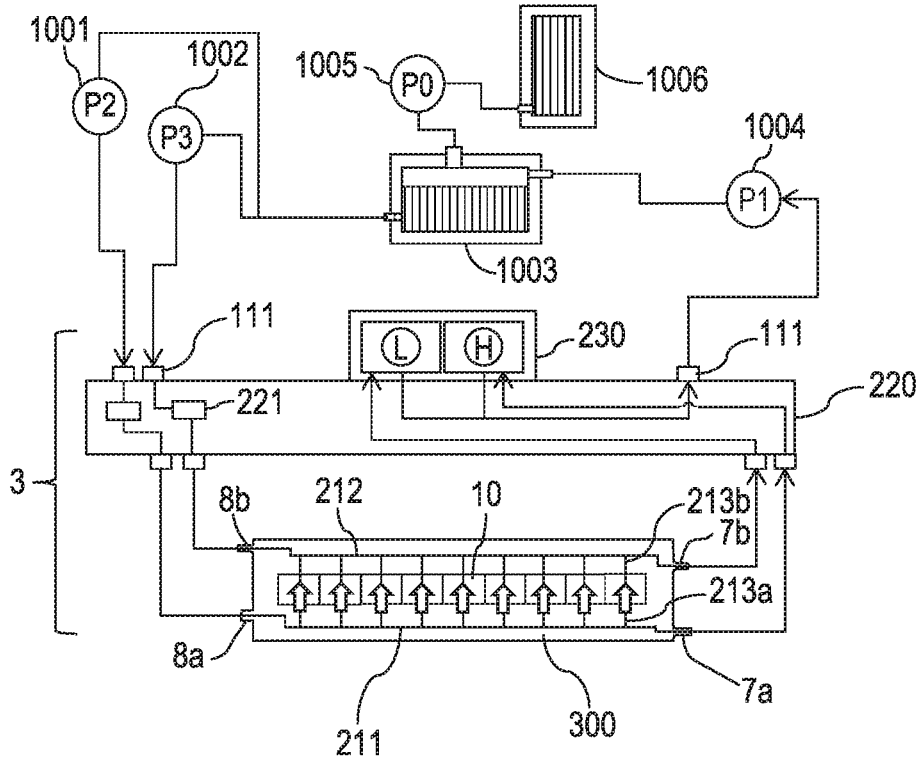
FIG. 15 is a schematic view illustrating a second circulation path of the liquid ejecting apparatus of the present invention.

FIG. 15 is a schematic view illustrating the second circulation path that is in a circulation state different from the first circulation path described above (refer to FIG. 7) out of circulation flow passages applied to the recording apparatus of the embodiment. What is mainly different from the first circulation path described above is as follows. The two pressure controlling mechanisms included in the negative pressure control unit 230 are mechanisms (mechanism components having the same working of a so-called "back pressure regulator") that control fluctuations of a pressure on the upstream side of the negative pressure control unit 230 within a certain range based on a desired set pressure. In addition, the second circulation pump 1004 works as a negative pressure source that decompresses a downstream side of the negative pressure control unit 230. The first circulation pump (high-pressure side) 1001 and the first circulation pump (low-pressure side) 1002 are disposed on the upstream side of the liquid ejecting head, and the negative pressure control unit 230 is disposed on the downstream side of the liquid ejecting head.

The negative pressure control unit 230 of the second circulation path stabilizes pressure fluctuations on the upstream side (the liquid ejection unit 300 side) within a certain range based on a pressure set in advance even when there are fluctuations of flow rate, which occur due to a change in recording duty when the liquid ejecting head 3 performs recording. Since an effect of a water head pressure of the buffer tank 1003 on the liquid ejecting head 3 is able to be suppressed in this manner, choice of layout of the buffer tank 1003 in the recording apparatus 1000 is able to be widened. Instead of the second circulation pump 1004, for example, also a hydraulic head tank that is disposed with a predetermined hydraulic head difference compared to the negative pressure control unit 230 is adoptable. By having one pump on a side where an ink is collected from the liquid ejecting head 3 also in the embodiment, a total number of pumps in the apparatus is able to be reduced, and thus an apparatus size is able to be made smaller. As in the first embodiment, as illustrated in FIG. 15, the negative pressure control unit 230 includes the two pressure controlling mechanisms in which control pressures different from each other are set. The high-pressure setting side (written as H in FIG. 15) and the low-pressure setting side (written as L in FIG. 15), which are in the two negative pressure controlling mechanisms, are respectively connected to the common supply flow passage 211 and the common collecting flow passage 212 in the liquid ejection unit 300 via the liquid supply unit 220. In addition, the first inflow orifice 7*a* and the first collecting orifice 8*a* are formed in the common supply flow passage 211, the first inflow orifice 7*a* is fluidly connected to the first circulation pump (first liquid delivery pump) 1001, and the first collecting orifice 8*a* is fluidly connected to the pressure controlling mechanism H. The second inflow orifice 7*b* and the second collecting orifice 8*b* are formed in the common collecting flow passage 212, the second inflow orifice 7*b* is fluidly connected to the first circulation pump (second liquid delivery pump) 1002, and the second collecting orifice 8*b* is fluidly connected to the pressure controlling mechanism L.

The two negative pressure controlling mechanisms and the two first circulation pumps control a pressure of the common supply flow passage 211 relatively to a pressure of the common collecting flow passage 212. Accordingly, the flow of an ink reaches the common collecting flow passage 212 from the common supply flow passage 211 via the individual supply flow passages 213*a* and a flow passage inside each element substrate 10. An ink supplied from each inflow orifice flows to the collecting orifice of each common flow passage without going through each element substrate. As described above, the same ink flow state as the first circulation path is obtained in the liquid ejection unit 300 in the second circulation path. However, in the first circulation path illustrated in FIG. 7, a liquid flowed into the liquid supply units 220 from the liquid connecting units 111 is supplied to the joint rubber 100 after going through the negative pressure control unit 230. On the contrary, in the second circulation path illustrated in FIG. 15, a liquid collected from the pressure chambers 23 flows to the outside of the liquid ejecting head from the liquid connecting units 111 via the negative pressure control unit 230 after passing through the joint rubber 100.

The second circulation path has two advantages different from a case of the first circulation path. The first advantage is that a concern over garbage or foreign substances generated from the negative pressure control unit 230 flowing into the head is small since the negative pressure control unit 230 is disposed on the downstream side of the liquid ejecting head 3 in the second circulation path. The second advantage is that a maximum value of flow rate necessary for supplying from the buffer tank 1003 to the liquid ejecting head 3 is smaller in the second circulation path than the case of the first circulation path. The reason is as follows. A total of flow rate inside the common supply flow passage 211 and the common collecting flow passage 212 in a case where an ink circulates at the time of recording standby is set as A. The value of A is defined as minimum flow rate necessary to keep a temperature difference in the liquid ejection unit 300 within a desired range in a case of controlling the temperature of the liquid ejecting head 3 during recording standby. In addition, ejection flow rate in a case of ejecting an ink (at the time of full ejection) from all ejection orifices of the liquid ejection unit 300 is defined as F. Then, since the set flow rate of the first circulation pump (high-pressure side) 1001 and the first circulation pump (low-pressure side) 1002 is A in a case of the first circulation path (refer to FIG. 7), a maximum value of a liquid supply amount to the liquid ejecting head 3, which is necessary at the time of full ejection, is A+F.

On the other hand, a liquid supply amount to the liquid ejecting head 3 which is necessary at the time of recording standby in a case of the second circulation path (refer to FIG. 15) is the flow rate A. A supply amount to the liquid ejecting head 3 which is necessary at the time of full ejection is the flow rate F. Then, in a case of the second circulation path, a larger value of A and F is a total value of set flow rate of the first circulation pump (high-pressure side) 1001 and the first circulation pump (low-pressure side) 1002, that is, a maximum value of necessary supply flow rate. For this reason, insofar as the same configuration of the liquid ejection unit 300 is used, a maximum value (A or F) of necessary supply flow rate in the second circulation path is invariably smaller than a maximum value (A+F) of necessary supply flow rate in the first circulation path. For this reason, in a case of the second circulation path, a degree of freedom of an adoptable circulation pump improves, thereby for example, a low-cost circulation pump with a simple configuration is able to be used or a load of a cooler (not illustrated) provided in a main body side path is able to be reduced. Thus, there is an advantage that costs of the recording apparatus main body is able to be reduced. This advantage is larger when the line head has a relatively larger value of A or F, and is more effective when the line head is a line head having a longer length in a longitudinal direction.

On the other hand, the first circulation path is advantageous over the second circulation path in some points. That is, since flow rate in the liquid ejection unit 300 is maximum at the time of recording standby in the second circulation path, the lower recording duty an image has, a state where the higher negative pressure is applied to the vicinity of each ejection orifice is caused. For this reason, when a head width (a length of the liquid ejecting head in a shorter-length direction) is decreased by decreasing in particular, flow passage widths (lengths in a direction orthogonal to a liquid flowing direction) of the common supply flow passages 211 and the common collecting flow passages 212, a high negative pressure is applied to the vicinity of the ejection orifices with a low duty image of which unevenness is likely to be seen. For this reason, there is a possibility that an effect of satellite drops increases. On the other hand, since a high negative pressure is applied to the vicinity of the ejection orifices when a high duty image is formed, there are advantages that satellite drops are unlikely to be seen even when the satellite drops are generated and an effect on the image is small in a case of the first circulation path. In selection of the two circulation paths, a suitable circulation path is adoptable, in light of specifications (the ejection flow rate F, the minimum circulating flow rate A and in-head flow passage resistance) of the liquid ejecting head and the recording apparatus main body.

Since reverse flow to the common collecting flow passage 212 is able to be suppressed regardless of a drive state of each element substrate 10 and a fluctuation range of circulating (supply) flow rate is able to be restrained, a head configuration that allows maintaining circulating flow, which enables securing an effect of circulation, is adopted also in the second circulation path as the first circulation path.

Second Embodiment

Figure 16A:
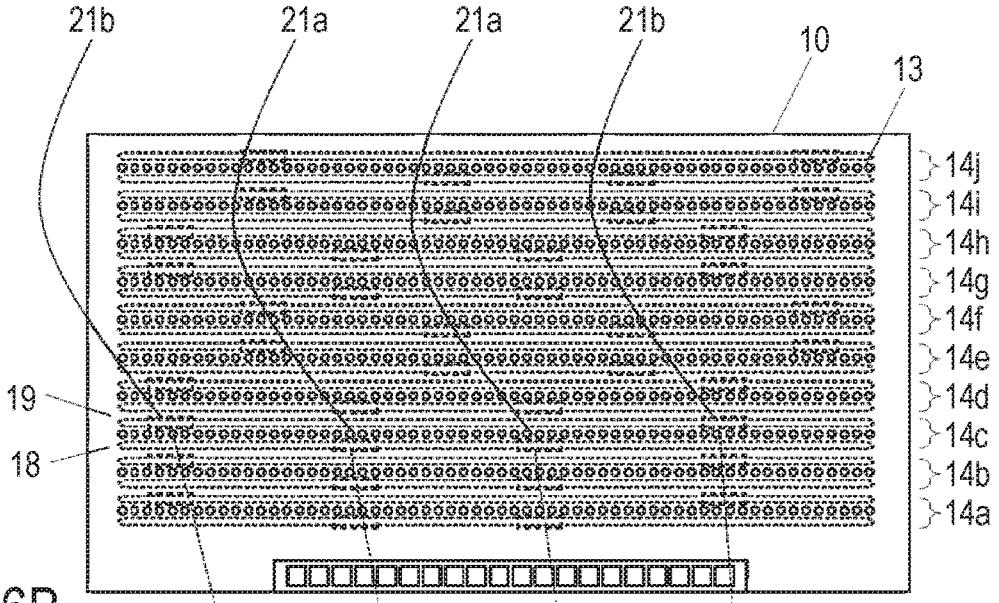
FIGS. 16A and 16B are a plan view of an element substrate according to a second embodiment of the present invention and a graph illustrating a relationship between a position of the element substrate and a result of temperature calculation.
Figure 16B:
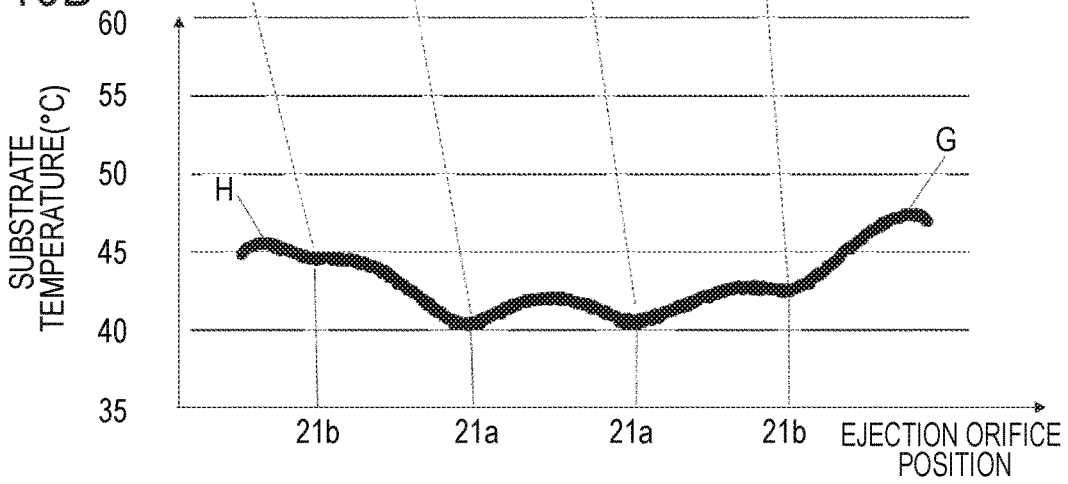

Next, a second embodiment of the present invention will be described. Since a basic configuration of the liquid ejecting head of the embodiment is the same as in the first embodiment, only a characteristic configuration will be described. FIGS. 16A and 16B are schematic views illustrating a relationship between a position of each of the openings 21 of the lid member 20 and a calculation result of a temperature of each portion of the element substrate 10 with one ejection orifice line 14*c*, out of the plurality of ejection orifice lines 14*a* to 14*j* provided on the element substrate 10 of the embodiment, given as an example. As illustrated in FIG. 16A, the openings for collection 21*b* are respectively disposed near both end parts of the element substrate 10 in the ejection orifice line direction, and the two openings for supply 21*a* are disposed side by side between the openings for collection 21*b* in the ejection orifice line direction in the embodiment. In other words, both openings positioned at both ends in the ejection orifice line direction are the openings for collection 21*b*, out of the plurality of openings for supply 21*a* and the plurality of openings for collection 21*b*. By disposing in this manner, the openings for collection 21*b* are disposed at both end parts of the element substrate 10 in the ejection orifice line direction, respectively, and temperatures of both end parts are almost the same as illustrated in FIG. 16B. A temperature difference between a position G of the ejection orifice 13 at an end part far from the openings for collection 21*b* and a position H of the ejection orifice 13 at an end part on an opposite side thereto is able to be restrained at 1.6° C., which is low. Accordingly, since a temperature difference between the element substrates 10 adjacent to each other in the line type liquid ejecting head is small, the unevenness of an image formed by liquid ejection is small. Since the openings for collection 21*b*, of which temperatures are more likely to rise than the openings for supply 21*a* are, are disposed at the end parts, the temperatures of the end parts of the element substrate 10 are likely to increase. However, in order to adhere to the supporting member 30, a region where the supply flow passage 18 and the collecting flow passage 19 are not formed exists in the end part of the element substrate 10 as an adhesion part in general. In a case where the element substrate 10 is formed of a metal such as Si, the adhesion part conducts heat better than a portion where a flow passage is formed does, serving as a heat dissipation path. In particular, in a case where the supporting member 30 is a member formed of a material that has high thermal conductivity and is likely to dissipate heat, such as alumina, the closer to the end parts of the element substrate 10, the more likely heat is to be dissipated to the supporting member 30 and the more likely a substrate temperature is to decline. When temperatures of a center part of the element substrate 10 of which heat is unlikely to be dissipated and the end parts of which heat is likely to be dissipated are controlled the same, there is a possibility that a temperature difference occurs due to a heat dissipation amount difference and becomes a cause of image unevenness. When a configuration where the closer to the end parts of the element substrate 10, the more likely a substrate temperature is to rise is adopted as in the embodiment, a temperature rise in the end parts of the element substrate 10 and heat dissipation offset each other, a temperature difference between the center part of the element substrate 10 and the end parts reduces, and the occurrence of unevenness of an image is able to be suppressed.

Third Embodiment

Figure 17:
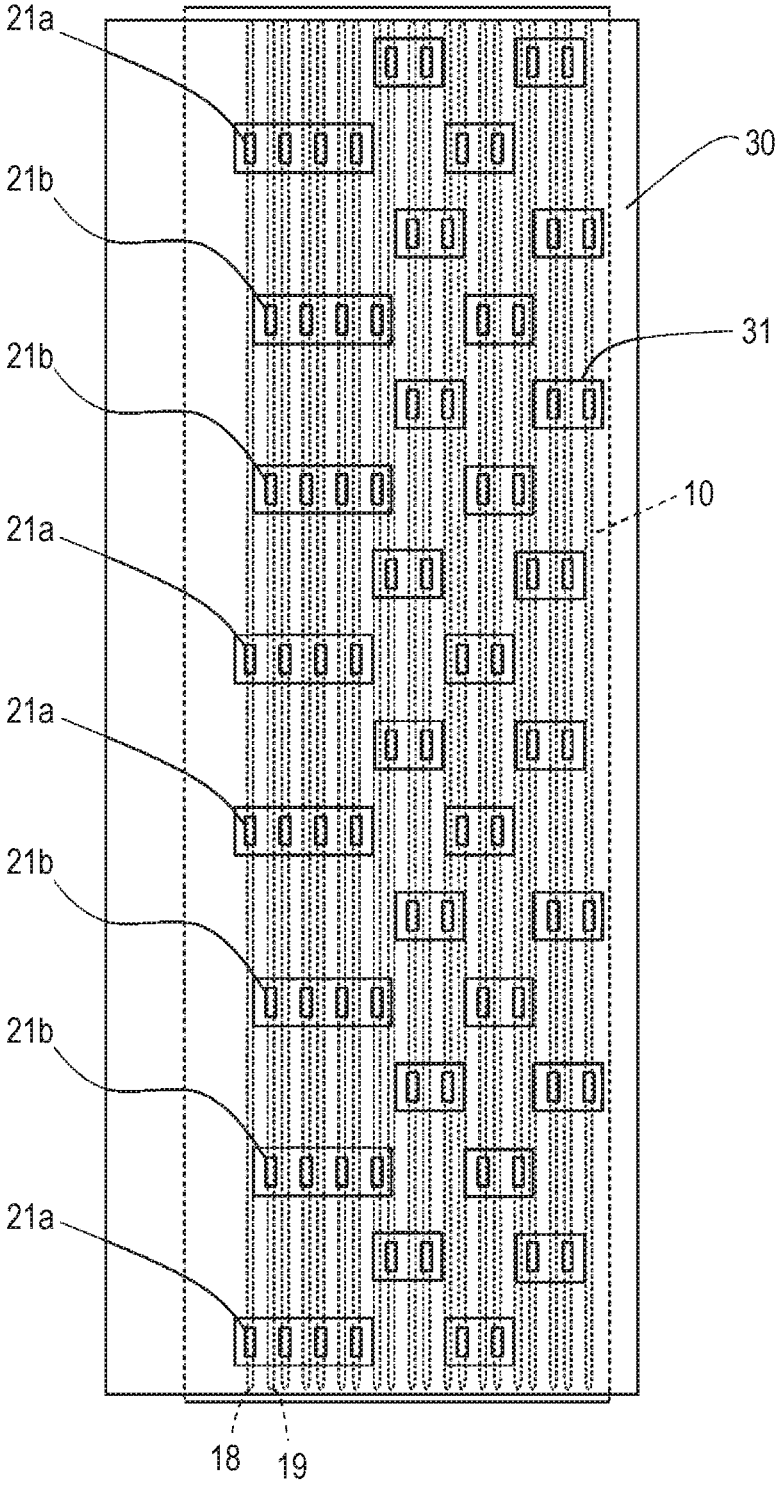
FIG. 17 is a plan view schematically illustrating an element substrate and a supporting member according to a third embodiment of the present invention.

Next, a third embodiment of the present invention will be described. Since a basic configuration of the liquid ejecting head of the embodiment is the same as in the first embodiment, only a characteristic configuration will be described. FIG. 17 is a plan view illustrating the openings 21 of the lid member 20 of the embodiment and the liquid communication orifices 31 of the supporting member 30. The element substrate 10 of the embodiment is long in the ejection orifice line direction compared to the first embodiment and the second embodiment, and a larger number of openings 21 are disposed. In an example illustrated in FIG. 17, four openings for supply 21*a* and four openings for collection 21*b* are provided for one ejection orifice line. When one ejection orifice line is given as an example, the openings for supply 21*a* are respectively disposed near both end parts of the element substrate 10 in the ejection orifice line direction. Between the openings for supply 21*a* at both ends in the ejection orifice line direction, two openings for collection 21*b*, two openings for supply 21*a* and two openings for collection 21*b* are disposed side by side in this order. In a case where the number of the openings for supply 21*a* and the number of the openings for collection 21*b* are equal to each other and even numbers, the same type of openings can be disposed at both end parts, and the plurality of openings for supply 21*a* and the plurality of openings for collection 21*b* can be disposed in the ejection orifice line direction so as to show symmetric disposition order with respect to the center in the ejection orifice line direction. As a result, a local temperature rise of the end parts of the element substrate 10 is restrained, and image unevenness is able to be made unlikely to occur. In a case where the openings for supply 21*a* and the openings for collection 21*b* are alternately disposed along the ejection orifice line direction, different types of openings are disposed at both end parts of the element substrate 10 in the ejection orifice line direction. An end part side where there are the openings for collection 21*b* has a high temperature compared to an end part on an opposite side where there are the openings for supply 21*a*, and there is a possibility that temperature distribution in the element substrate 10 becomes great. In addition, when a temperature difference between the element substrates adjacent to each other becomes large in the line type head and an image is formed using the liquid ejecting head, large image unevenness which is highly visible is likely to occur. However, the embodiment enables a temperature difference between both end parts of the element substrate 10 to be small and the occurrence of image unevenness to be restrained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-021660, filed Feb. 8, 2019, which is hereby incorporated by reference herein in its entirety.

What is claimed is:

1. A liquid ejecting head comprising, on an element substrate:

an ejection orifice line formed of a plurality of ejection orifices that ejects a liquid;

a plurality of pressure chambers that communicates with the plurality of ejection orifices, respectively;

a first flow passage and a second flow passage that extend along the ejection orifice line and communicate with the plurality of pressure chambers, respectively, the first flow passage being a supply flow passage for supplying the liquid to the pressure chambers and the second flow passage being a collecting flow passage for collecting the liquid from the pressure chambers;

a plurality of first openings that communicates with the first flow passage, the first openings being openings for supply; and a plurality of second openings that communicates with the second flow passage, the second openings being openings for collection, wherein the number of the first openings and the number of the second openings are equal to each other and even numbers, out of the plurality of first openings and the plurality of second openings, outermost openings positioned at both ends in an ejection orifice line direction are the first openings, and wherein widths of the first openings which are disposed at both ends in the ejection orifice line direction are wider than widths of the second openings in the ejection orifice line direction.

2. The liquid ejecting head according to claim 1, wherein a differential pressure is generated between the first flow passage and the second flow passage.

3. The liquid ejecting head according to claim 1, wherein the plurality of first openings and the plurality of second openings are provided in the ejection orifice line direction so as to show symmetric disposition order with respect to a center in the ejection orifice line direction.

4. The liquid ejecting head according to claim 1, wherein a plurality of the ejection orifice lines for ejecting a plurality of types of the liquids is provided on the element substrate, and the first flow passage, the plurality of first openings, the second flow passage and the plurality of second openings are provided to correspond to each ejection orifice line.

5. The liquid ejecting head according to claim 1, wherein the element substrate has a lid member on an opposite side to a surface where the ejection orifices are formed, and the lid member is provided with the first openings and the second openings, a supporting member laminated on the lid member is provided with a plurality of liquid communication orifices that communicates with the first openings and the second openings, and the supporting member is adhered to the lid member.

6. The liquid ejecting head according to claim 5, wherein the lid member is formed of a photosensitive resin material.

7. The liquid ejecting head according to claim 5, wherein the lid member is formed of a silicon plate.

8. The liquid ejecting head according to claim 1, wherein the pressure chambers each include an energy generating element therein, and a plurality of the element substrates, each of which is provided with the ejection orifices, the pressure chambers, the energy generating elements, the first flow passage and the second flow passage, are disposed side by side so as to form a line.

9. A liquid ejecting apparatus comprising:

liquid ejecting head according to claim 1; and a transporting unit that transports a recording medium.

10. The liquid ejecting apparatus according to claim 9, wherein a dimension of the liquid ejecting head in a width direction orthogonal to a transporting direction of the recording medium by the transporting unit is equal to or greater than a dimension of the recording medium in the width direction.

* * * * *